US010368606B2

(12) United States Patent
Meir

(10) Patent No.: US 10,368,606 B2
(45) Date of Patent: Aug. 6, 2019

(54) RESILIENT KNITTED COMPONENT WITH WAVE FEATURES

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 10 days.

(21) Appl. No.: 14/252,948

(22) Filed: Apr. 15, 2014

(65) Prior Publication Data

US 2015/0289579 A1 Oct. 15, 2015

(51) Int. Cl.

| | |
|---|---|
| ***A43B 1/00*** | (2006.01) |
| ***A43B 1/04*** | (2006.01) |
| ***A43B 23/02*** | (2006.01) |
| ***D04B 1/10*** | (2006.01) |

(52) U.S. Cl.

CPC ..... *A43B 1/04* (2013.01); *A43B 1/0018* (2013.01); *A43B 23/0205* (2013.01); *A43B 23/027* (2013.01); *D04B 1/102* (2013.01); *D10B 2403/033* (2013.01); *D10B 2501/043* (2013.01)

(58) Field of Classification Search

CPC ..... A43B 1/04; A43B 1/0018; A43B 23/027; A43B 23/0205; D04B 1/102; D10B 2403/033; D10B 2501/043

USPC ..... 66/170, 173

See application file for complete search history.

(56) References Cited

U.S. PATENT DOCUMENTS

| | | | | |
|---|---|---|---|---|
| 391,005 | A * | 10/1888 | Munsing | D04B 1/14 2/113 |
| 601,192 | A | 3/1898 | Woodside | |
| 1,087,690 | A | 2/1914 | Scott | |
| 1,215,198 | A | 2/1917 | Rothstein | |
| 1,597,410 | A * | 8/1926 | Hinchliff | D04B 1/24 2/147 |
| 1,597,934 | A | 8/1926 | Stimpson | |
| 1,886,172 | A | 11/1932 | Joha | |
| 1,902,780 | A | 3/1933 | Holden et al. | |
| 1,910,251 | A | 5/1933 | Joha | |
| 2,001,293 | A | 5/1935 | Wilson | |

(Continued)

FOREIGN PATENT DOCUMENTS

| | | |
|---|---|---|
| CN | 2825672 Y | 10/2006 |
| CN | 101583294 A | 11/2009 |

(Continued)

OTHER PUBLICATIONS

Let me ExplainKnit: Sara's blog for explaining knitting things, "Curl and Bounce," May 2, 2007, http://explaiknit.typepad.com/let_me_explaiknit/structure/.*

(Continued)

*Primary Examiner* — Danny Worrell

*Assistant Examiner* — Jocelyn Bravo

(74) *Attorney, Agent, or Firm* — Brinks Gilson & Lione

(57) ABSTRACT

A knitted component formed of unitary knit construction includes a ridge structure and a channel structure. The ridge structure is biased to curl about a first axis in a first direction toward a compacted position. The channel structure is biased to curl about a second axis in a second direction toward a compacted position. The first direction is opposite the second direction. Courses of the ridge structure extend in the same direction as the first axis. Courses of the channel structure extend in the same direction as the second axis.

17 Claims, 21 Drawing Sheets

(56) References Cited

U.S. PATENT DOCUMENTS 2,047,724 A 7/1936 Zuckerman
2,147,197 A 2/1939 Glidden
2,170,741 A 8/1939 Ware
2,220,803 A * 11/1940 Lesher ..... A41B 11/12 66/172 E
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,698,009 A 12/1954 Cusick
2,994,322 A 8/1961 Cullen et al.
3,307,379 A * 3/1967 Adams ..... A41B 11/005 66/178 R
3,583,081 A 6/1971 Hayashi
3,694,940 A 10/1972 Stohr
3,704,474 A 12/1972 Winkler
3,766,566 A 10/1973 Tadakoro
3,778,856 A 12/1973 Christie et al.
3,952,427 A 4/1976 Von den Benken et al.
3,972,086 A 8/1976 Belli et al.
4,027,402 A 6/1977 Liu et al.
4,031,586 A 6/1977 Von den Benken et al.
4,034,580 A * 7/1977 Holder ..... D04B 1/106 2/239
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A 5/1984 Zaino
4,465,448 A 8/1984 Aldridge
4,607,439 A 8/1986 Harada
4,702,091 A * 10/1987 Good ..... D04B 1/26 66/171
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,152,025 A 10/1992 Hirmas
5,192,601 A 3/1993 Neisler
5,345,638 A 9/1994 Nishida
5,353,524 A 10/1994 Brier
5,371,957 A 12/1994 Gaudio
5,417,091 A 5/1995 Moser
5,419,161 A 5/1995 Bodenschatz et al.
5,428,975 A * 7/1995 Lee, III ..... A41B 11/00 2/239
5,461,884 A 10/1995 McCartney et al.
5,511,323 A 4/1996 Dahlgren
5,572,860 A 11/1996 Mitsumoto et al.
5,575,090 A 11/1996 Condini
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,088,936 A 7/2000 Bahl
6,151,802 A 11/2000 Reynolds
6,170,175 B1 1/2001 Funk
6,308,438 B1 10/2001 Throneburg et al.
6,333,105 B1 12/2001 Tanaka et al.
6,401,364 B1 6/2002 Burt
6,558,784 B1 5/2003 Norton et al.
6,588,237 B2 7/2003 Cole et al.
6,622,528 B2 9/2003 Masse et al.
6,754,983 B2 6/2004 Hatfield et al.
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,347,011 B2 3/2008 Dua et al.
7,441,348 B1 10/2008 Dawson
7,543,397 B2 6/2009 Kilgore et al.
7,568,298 B2 8/2009 Kerns
7,682,219 B2 3/2010 Falla
7,774,956 B2 * 8/2010 Dua ..... A43B 1/04 36/45
8,448,474 B1 5/2013 Tatler et al.
8,490,299 B2 7/2013 Dua et al.
2002/0078599 A1 6/2002 Delgorgue et al.
2002/0148258 A1 10/2002 Cole et al.
2003/0126762 A1 7/2003 Tseng
2003/0191427 A1 10/2003 Jay et al.
2004/0118018 A1 6/2004 Dua
2004/0181972 A1 9/2004 Csorba
2005/0115284 A1 6/2005 Dua
2005/0193592 A1 9/2005 Dua et al.
2005/0273988 A1 12/2005 Christy
2005/0284000 A1 12/2005 Kerns
2006/0059715 A1 3/2006 Aveni
2006/0162187 A1 7/2006 Byrnes et al.
2007/0022627 A1 2/2007 Sokolowski et al.
2007/0180730 A1 8/2007 Greene et al.
2008/0017294 A1 1/2008 Bailey et al.
2008/0078102 A1 4/2008 Kilgore et al.
2008/0110048 A1 5/2008 Dua et al.
2008/0189830 A1 8/2008 Egglesfield
2008/0313939 A1 12/2008 Ardill
2009/0068908 A1 3/2009 Hinchcliff
2010/0051132 A1 3/2010 Glenn
2010/0154256 A1 6/2010 Dua
2010/0170651 A1 7/2010 Scherb et al.
2011/0030244 A1 2/2011 Motawi et al.
2011/0078921 A1 4/2011 Greene et al.
2012/0233882 A1 9/2012 Huffa et al.
2012/0255201 A1 10/2012 Little

FOREIGN PATENT DOCUMENTS

CN 202369723 U * 8/2012 ..... D04B 1/10
DE 870963 C 3/1953
DE 1084173 6/1960
DE 19738433 4/1998
DE 19728848 1/1999
EP 0279950 A2 8/1988
EP 0448714 7/1996
EP 0728860 8/1996
EP 0758693 2/1997
EP 0898002 A2 2/1999
EP 1233091 8/2002
EP 1437057 A1 7/2004
EP 1563752 A1 8/2005
EP 1602762 A1 12/2005
EP 1972706 A1 9/2008
EP 2649898 A1 10/2013
FR 2171172 9/1973
FR 2239116 A5 2/1975
GB 375376 A 6/1932
GB 538865 8/1941
GB 2018837 A 10/1979
GB 1603487 11/1981
JP H06113905 4/1994
JP H08109553 4/1996
JP H11302943 11/1999
JP 2003-064501 A 3/2003

(56) References Cited

FOREIGN PATENT DOCUMENTS

| | | |
|---|---|---|
| JP | 2009-144273 A | 7/2009 |
| NL | 7304678 | 10/1974 |
| TW | M400227 U | 3/2011 |
| TW | I478674 | 1/2014 |
| WO | 9003744 | 4/1990 |
| WO | 0032861 | 6/2000 |
| WO | 0231247 | 4/2002 |

OTHER PUBLICATIONS

Hanlon, Susan; "Stylish Squares," Dec. 2009, https://www.ravelry.com/patterns/library/the-stylish-square.*

ExplaiKnit, "Curl and Bounce," May 2, 2007, https://explaiknit.typepad.com/let_me_explaiknit/structure/.*

Declaration of Dr. Edward C. Frederick from the US Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmbH 2002) (book cover and back; pp. 2-3, 83).

International Search Report and Written Opinion in connection with PCT/US2009/056795 dated Apr. 20, 2010.

International Search Report and Written Opinion in connection with PCT/US2012/028576 dated Oct. 1, 2012.

International Search Report and Written Opinion in connection with PCT/US2012/028559 dated Oct. 19, 2012.

International Search Report and Written Opinion in connection with PCT/US2012/028534 dated Oct. 17, 2012.

International Preliminary Report on Patentability in connection with PCT/US2012/028534 dated Sep. 17, 2013.

International Preliminary Report on Patentability in connection with PCT/US2012/028576 dated Sep. 17, 2013.

International Preliminary Report on Patentability (including Written Opinion of the ISA) dated May 28, 2015 in International Application No. PCT/US2013/068841.

International Search Report and Written Opinion for Application No. PCT/US2015/014718, dated May 20, 2015, 13 pages.

Office Action, and English language translation thereof, in corresponding Taiwan Application Serial No. 104105147, dated Dec. 8, 2017, 28 pages.

Office Action of the Intellectual Property Office of Taiwan dated Jun. 29, 2018 for Taiwan Patent Application No. 106142467, with English translation (6 pp.).

Office Action and partial English language translation thereof, in Chinese Application No. 201580031309.X, dated Dec. 1, 2017, 22 pages.

Official Communication of the Mexican Institute of Industrial Property dated Mar. 27, 2019 for Mexican Patent Application No. MX/a/2016/013445 (without English translation (3 pp.).

* cited by examiner

RESILIENT KNITTED COMPONENT WITH WAVE FEATURES

BACKGROUND

This section provides background information related to the present disclosure which is not necessarily prior art.

Various articles can be made from or include a knitted component. Knitted components can be durable, can provide desirable look and textures, and can otherwise improve the article.

For example, articles of footwear can include an upper that includes a knitted component. The knitted component can be lightweight and, yet, durable. The knitted component can additionally provide flexibility to the upper. The knitted component can also provide desirable aesthetics to the upper. Moreover, the knitted component can also increase manufacturing efficiency of the upper. Furthermore, the knitted component can decrease waste and/or or make the upper more recyclable.

SUMMARY

A knitted component that provides resiliency to an object is disclosed. The knitted component is formed of unitary knit construction. The knitted component includes a ridge structure that includes a plurality of ridge courses. The knitted component also includes a channel structure that is adjacent the ridge structure. The channel structure includes a plurality of channel courses. The ridge structure is configured to move between a compacted position and an extended position, and the channel structure is configured to move between a compacted position and an extended position. The ridge structure is biased to curl about a first axis in a first direction toward the compacted position of the ridge structure. The channel structure is biased to curl about a second axis in a second direction toward the compacted position of the channel structure. The first direction is opposite the second direction. The ridge courses extend in the same direction as the first axis. The channel courses extend in the same direction as the second axis. The ridge structure is configured to uncurl toward the extended position in response to an applied force. The channel structure is configured to uncurl toward the extended position in response to an applied force.

Also, a method of manufacturing a resilient knitted component formed of unitary knit construction is disclosed. The method includes knitting a plurality of ridge courses to define a ridge structure of the knitted component. The ridge structure is biased to curl in a first direction about a first axis. Furthermore, the method includes knitting a plurality of channel courses to define a channel structure of the knitted component. The channel structure is biased to curl in a second direction about a second axis. The second direction is opposite the first direction. The ridge courses extend in the same direction as the first axis. The channel courses extend in the same direction as the second axis.

Moreover, an article of footwear is disclosed. The article of footwear includes a sole structure and an upper that is attached to the sole structure. The upper includes a knitted component formed of unitary knit construction. The knitted component includes a ridge structure that includes a plurality of ridge courses. The knitted component also includes a channel structure that is adjacent the ridge structure. The channel structure includes a plurality of channel courses. The ridge structure is configured to move between a compacted position and an extended position. The channel structure is configured to move between a compacted position and an extended position. The ridge structure is biased to curl about a first axis in a first direction toward the compacted position of the ridge structure. The channel structure is biased to curl about a second axis in a second direction toward the compacted position of the channel structure. The first direction is opposite the second direction. The ridge courses extend in the same direction as the first axis. The channel courses extend in the same direction as the second axis. The ridge structure is configured to uncurl toward the extended position of the ridge structure in response to a force applied to the ridge structure. The channel structure is configured to uncurl toward the extended position of the channel structure in response to a force applied to the channel structure.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Example embodiments will now be described more fully with reference to the accompanying drawings.

The following discussion and accompanying figures disclose a variety of concepts relating to knitted components. For example, FIG. 1 shows a knitted component 10 illustrated according to exemplary embodiments of the present disclosure.

At least a portion of knitted component 10 can be flexible, elastic, and resilient in some embodiments. More specifically, in some embodiments, knitted component 10 can resiliently stretch, deform, flex, or otherwise move between a first position and a second position. Additionally, knitted component 10 can be compressible and can recover from a compressed state to a neutral position.

Figure 1:
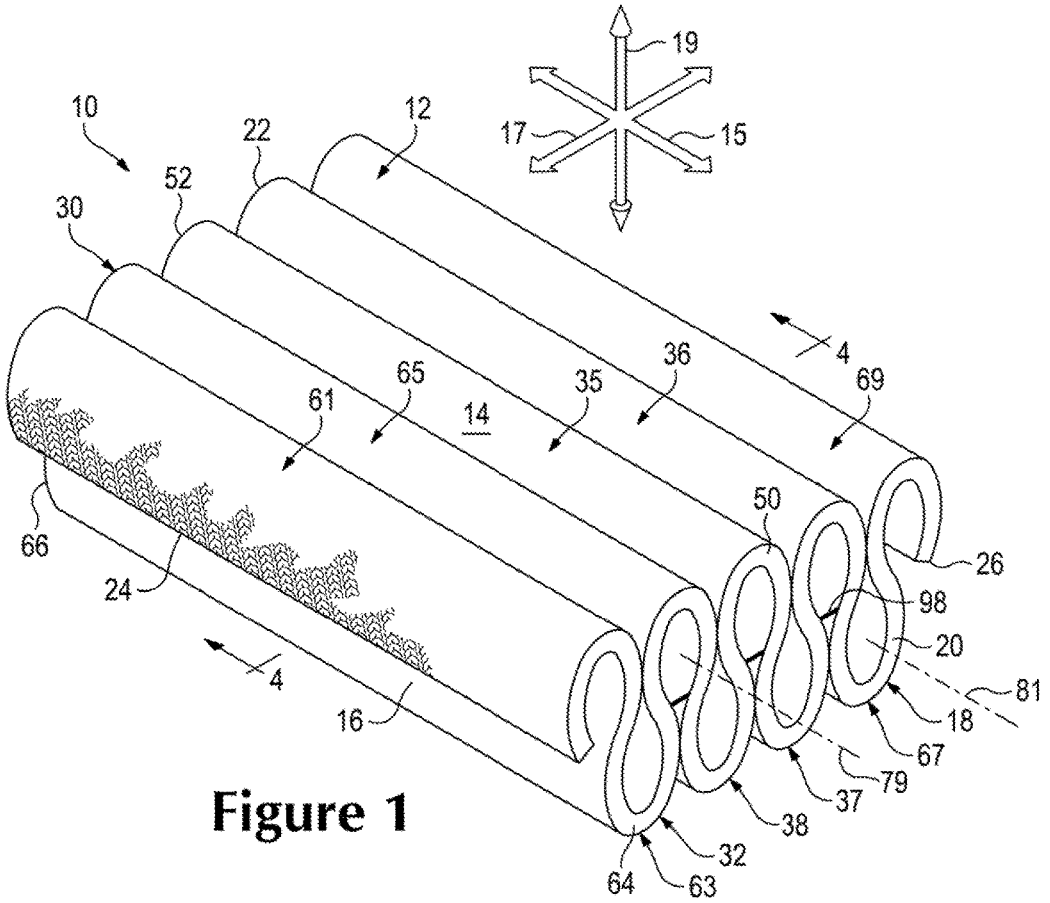
FIG. 1 is a perspective view of a knitted component according to exemplary embodiments of the present disclosure, wherein the knitted component is shown in a first position.
Figure 2:
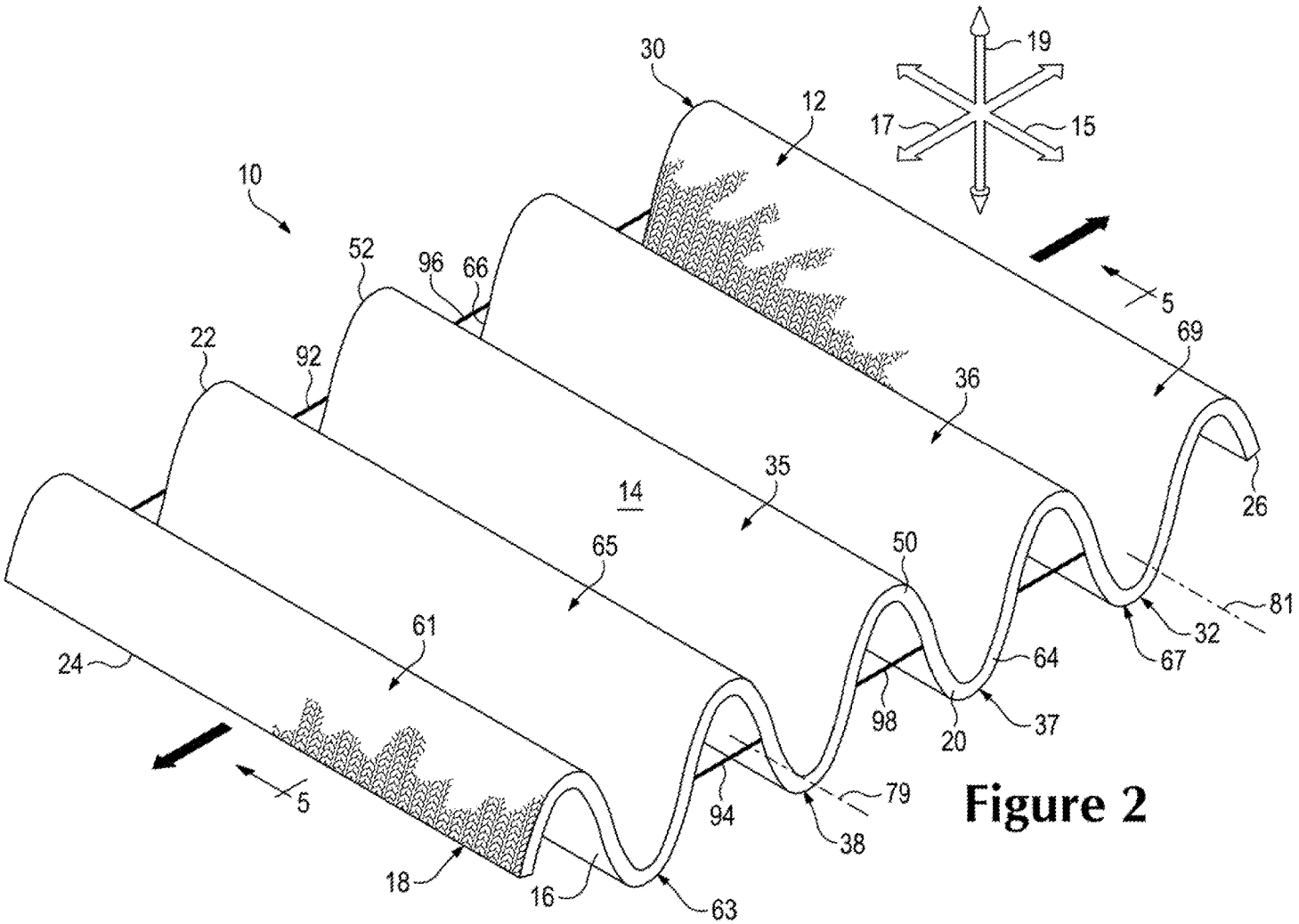
FIG. 2 is a perspective view of the knitted component of FIG. 1 shown in a second, stretched position.
Figure 3:
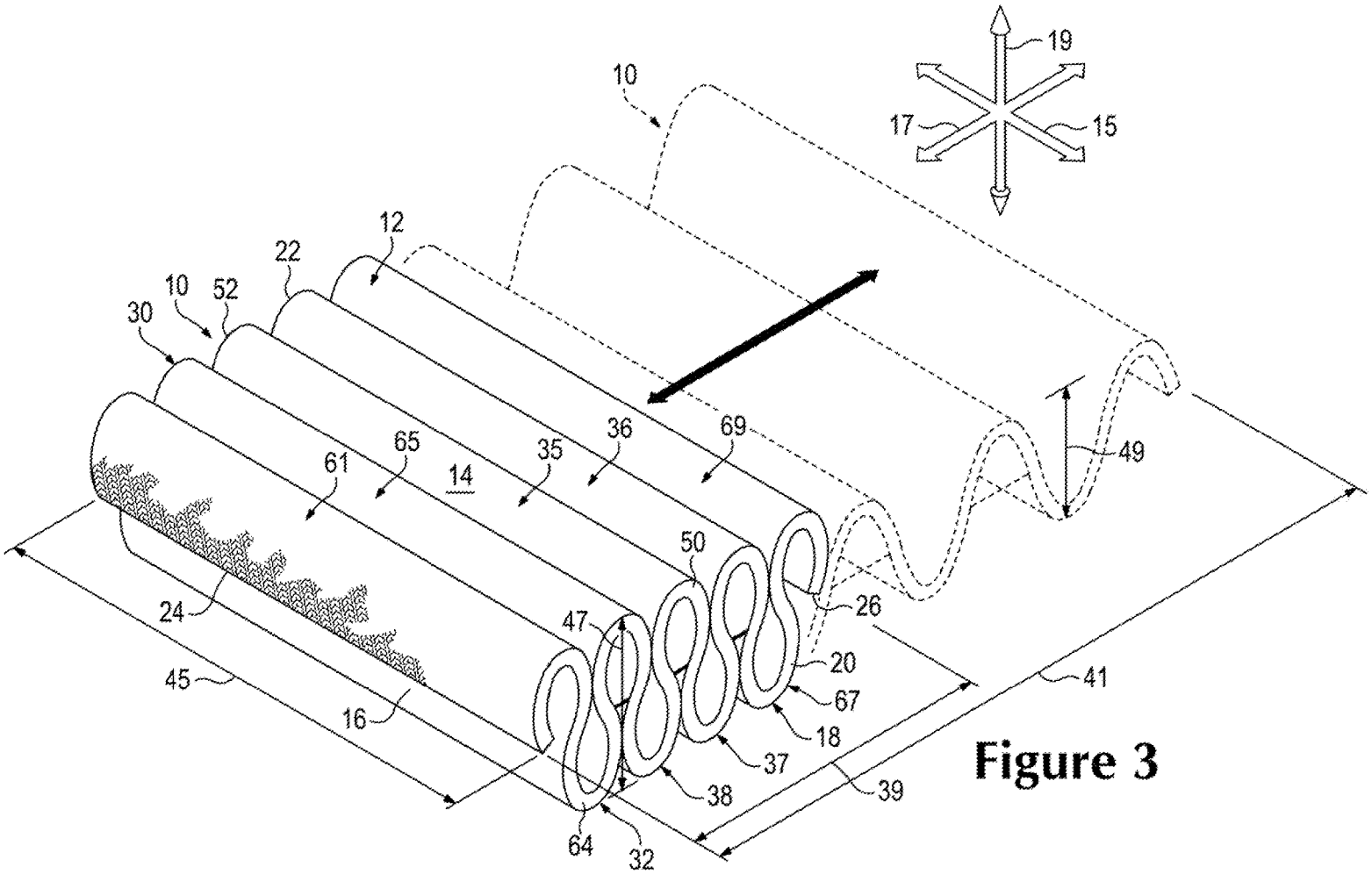
FIG. 3 is a perspective view of the knitted component of FIG. 1, wherein the knitted component is shown in the first position with solid lines, and wherein the knitted component is partially shown in the second position with broken lines.
Figure 7:
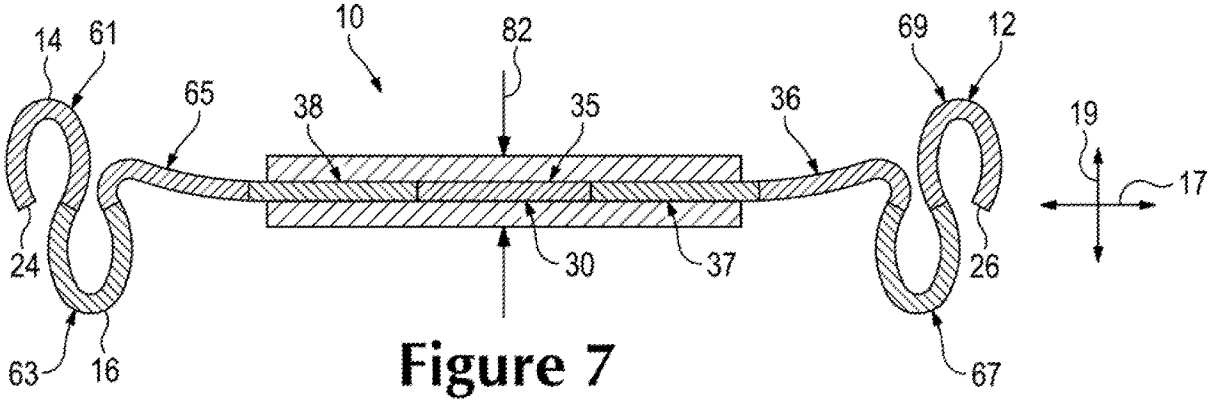
FIG. 7 is a cross section of the knitted component shown being deformed by a compression load.

FIG. 1 illustrates a first position of knitted component 10 according to some embodiments, and FIG. 2 illustrates a second position of knitted component 10 according to some embodiments. For purposes of clarity, FIG. 3 shows knitted component 10 in both positions, wherein the first position is represented in solid lines and the second position is represented in broken lines. In some embodiments, knitted component 10 can be biased to move toward the first position. Accordingly, a force can be applied to knitted component 10 to move knitted component 10 to the second position, and when released, knitted component 10 can resiliently recover and return to the first position. FIG. 7 illustrates knitted component 10 in a compressed state according to some embodiments. Knitted component 10 can recover to the first position of FIG. 1 once the compression load is reduced. The resiliency and elasticity of knitted component 10 can serve several functions. For example, knitted component 10 can deform resiliently under a load to cushion against the load. Then, once the load is reduced, knitted component 10 can recover and can continue to provide cushioning.

Knitted component 10 can also have two or more areas that are uneven or non-planar relative to each other. These non-planar areas can be arranged such that knitted component has a wavy, undulating, corrugated, or otherwise uneven appearance. In some embodiments, when knitted component 10 moves from the first position represented in FIG. 1 toward the second position represented in FIG. 2, knitted component 10 can at least partially flatten out. When moving back to the first position, the waviness of knitted component 10 can increase. The waviness of knitted component 10 can increase the range of motion and stretchability of knitted component 10. Accordingly, knitted component 10 can provide a high degree of dampening or cushioning.

Figure 21:
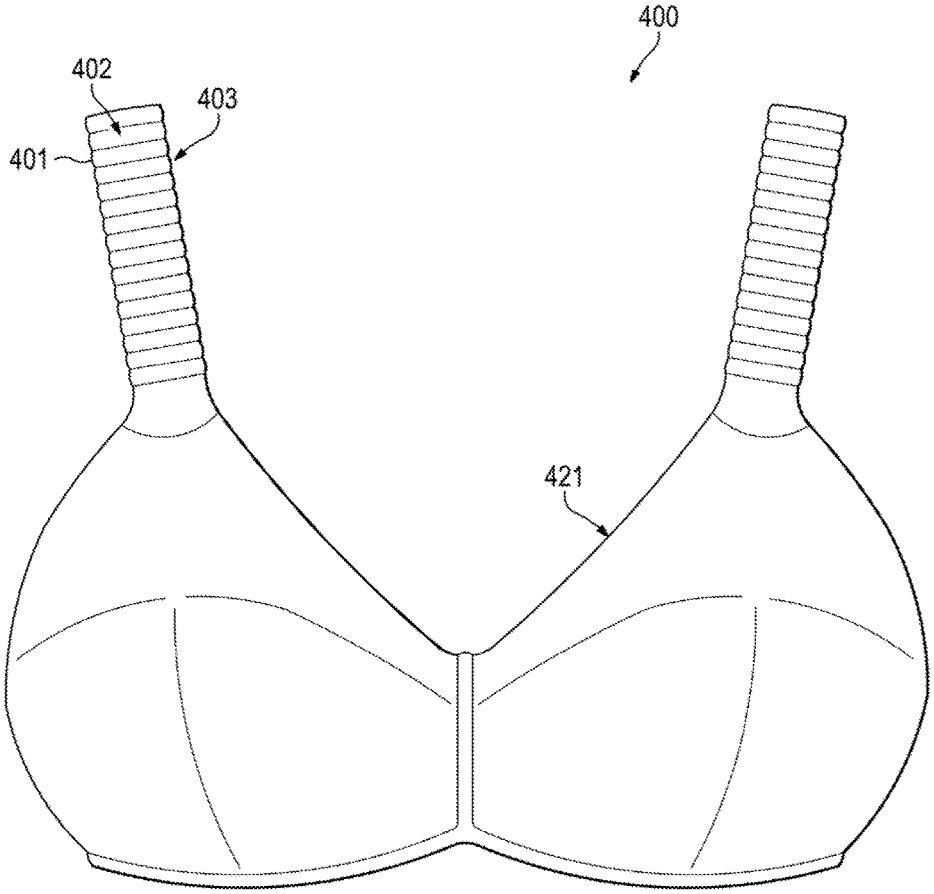
FIG. 21 is a front view of an article of apparel that includes a knitted component according to additional embodiments of the present disclosure.
Figure 22:
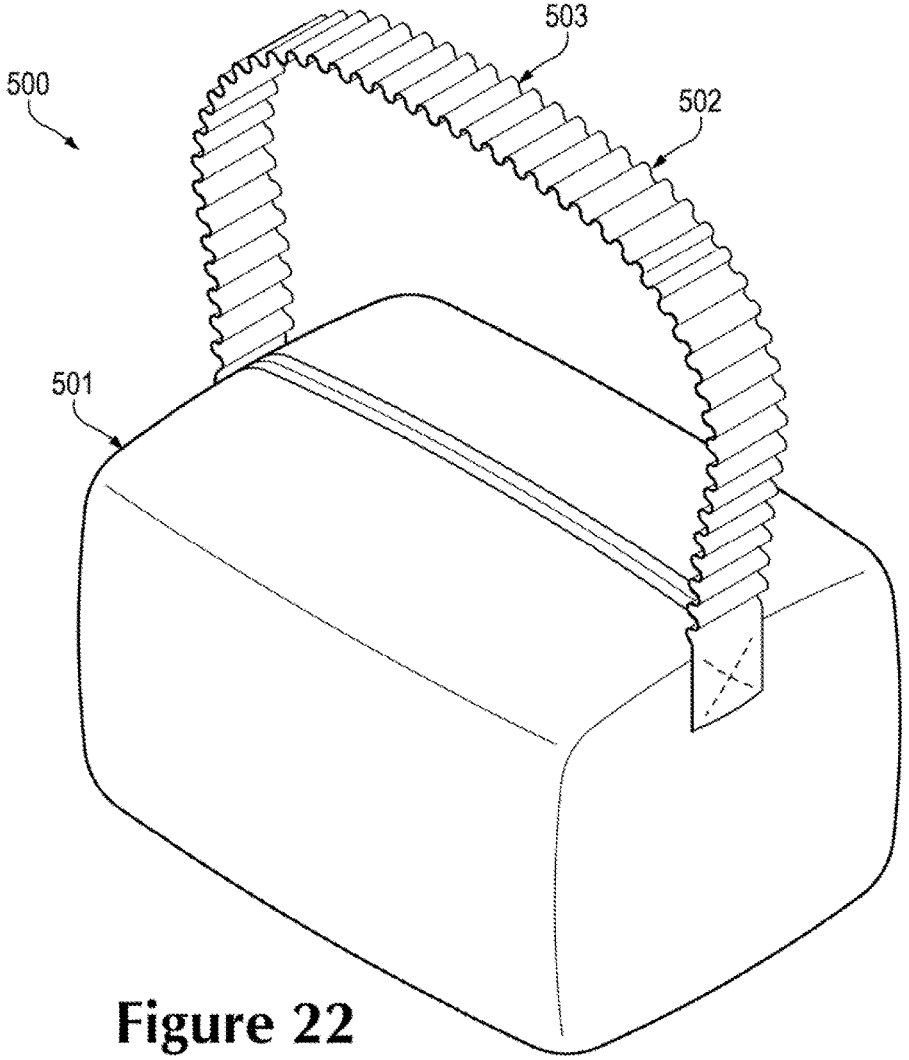
FIG. 22 is a perspective view of an article that includes a knitted component according to additional embodiments of the present disclosure.

The following discussion and accompanying figures also disclose articles that can incorporate knitted component 10. For example, knitted component 10 can be incorporated in an article of footwear as represented in FIGS. 17-20. In these embodiments, knitted component 10 can readily stretch to fit and conform to the wearer's foot or lower leg. The resilience of knitted component 10 can also provide cushioning for the wearer's foot or lower leg. Other objects can include knitted component 10 as well. For example, knitted component 10 can be included in a strap or other part of an article of apparel as represented in FIG. 21. Knitted component 10 can be further included in a strap for a bag or other container as represented in FIG. 22. Other objects can also include knitted component 10.

Configurations of Knitted Component

Referring now to FIGS. 1-8, knitted component 10 will be discussed in greater detail. Knitted component 10 can be of "unitary knit construction." As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component 10 having structures or elements that include one or more courses or wales of yarn or other knit material that are joined such that the structures or elements include at least one course or wale in common, such that the structures or elements share a common yarn, and/or such that the courses or wales are substantially continuous between each of the structures or elements. With this arrangement, a one-piece element of unitary knit construction is provided. In the exemplary embodiments, any suitable knitting process may be used to produce knitted component 10 formed of unitary knit construction, including, but not limited to a flat knitting process, such as warp knitting or weft knitting, as well as a circular knitting process, or any other knitting process suitable for providing a knitted component. Examples of various configurations of knitted components and methods for forming knitted component 10 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al., the disclosure of each being incorporated by reference in its entirety.

For reference purposes, knitted component 10 is illustrated with respect to a Cartesian coordinate system in FIGS. 1-8. Specifically, a longitudinal direction 15, a lateral direction 17, and a thickness direction 19 of knitted component 10 is shown. However, knitted component 10 can be illustrated relative to a radial or other coordinate system.

As shown in FIGS. 1-7, knitted component 10 can include a front surface 14 and a back surface 16. Moreover, knitted component 10 can include a peripheral edge 18. Peripheral edge 18 can define the boundaries of knitted component 10. Peripheral edge 18 can extend in the thickness direction 19 between front surface 14 and back surface 16. Peripheral edge 18 can be sub-divided into any number of sides. For example, peripheral edge 18 can include four sides as shown in the embodiment of FIGS. 1-3.

More specifically, as shown in FIGS. 1 and 2, peripheral edge 18 of knitted component 10 can be sub-divided into a first edge 20, a second edge 22, a third edge 24, and a fourth edge 26. First edge 20 and second edge 22 can be spaced apart in the longitudinal direction 15. Third edge 24 and fourth edge 26 can be spaced apart in the lateral direction 17. Third edge 24 can extend between first edge 20 and second edge 22, and fourth edge 26 can also extend between first edge 20 and second edge 22. In some embodiments, knitted component 10 can be generally rectangular. However, it will be appreciated that knitted component 10 can define any shape without departing from the scope of the present disclosure.

Figure 4:
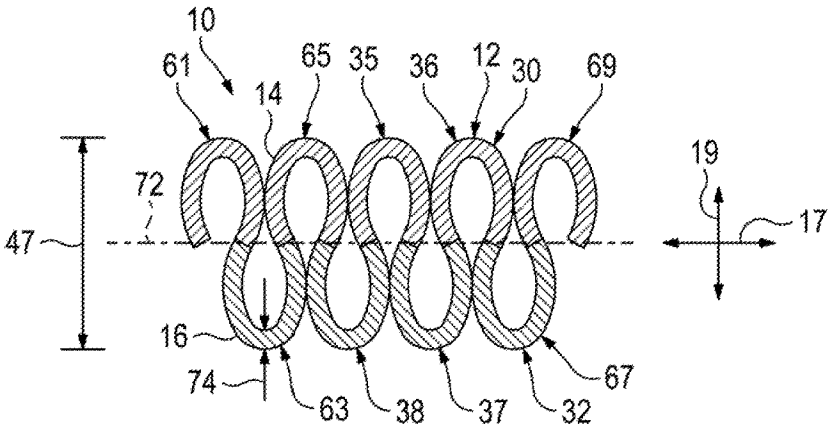
FIG. 4 is a cross section of the knitted component taken along the line 4-4 of FIG. 1.
Figure 5:
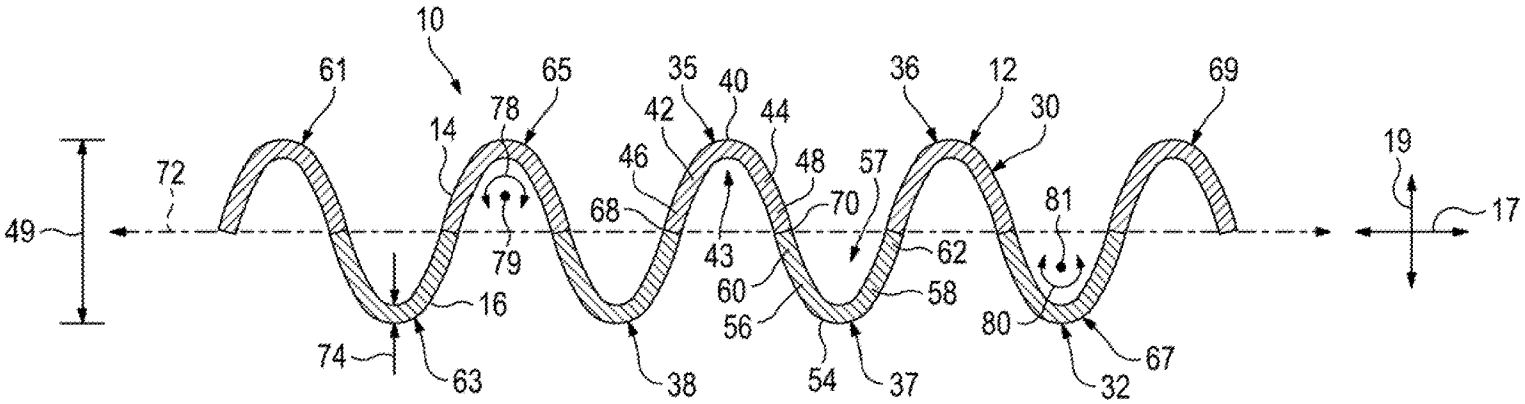
FIG. 5 is a cross section of the knitted component taken along the line 5-5 of FIG. 2.

Moreover, as shown in FIGS. 4 and 5, knitted component 10 can have a sheet thickness 74 that is measured from front surface 14 to back surface 16. In some embodiments, sheet thickness 74 can be substantially constant throughout knitted component 10. In other embodiments, sheet thickness 74 can vary with certain portions being thicker than other portions. It will be appreciated that sheet thickness 74 can be selected and controlled according to the diameter of yarn(s) used. Sheet thickness 74 can also be controlled according to the denier of the yarn(s). Additionally, sheet thickness 74 can be controlled according to the stitch density within knitted component 10.

Furthermore, knitted component 10 can have a plurality of wave features 12 in some embodiments. Stated differently, the knitted component 10 can be wavy in some embodiments. Those having ordinary skill in the art will understand that the terms "wave," "waviness," "wave feature," and other related terms as used within the present application, encompass a number of different shapes and configurations of uneven or non-planar features. For example, front surface 14 and/or back surface 16 can be rippled, wavy, undulated, corrugated or otherwise uneven and non-planar to define wave features 12. It will also be appreciated that wave features 12 can include a series of non-planar features or constructions. For example, wave features 12 can include peaks and troughs, steps, raised ridges and recessed channels, or other uneven features.

Wave features 12 can extend across knitted component 10 in any direction. Wave features 12 can also cause knitted component 10 to undulate in the thickness direction 19.

Knitted component 10 can include any suitable number of wave features 12, and wave features 12 can have any suitable shape. For example, in some embodiments, wave features 12 can include a plurality of ridge structures 30 and a plurality of channel structures 32.

Generally, ridge structures 30 can be raised areas of knitted component 10, and channel structures 32 can be lowered or recessed areas of knitted component 10. In some embodiments, two or more ridge structures 30 of knitted component 10 can have similar shape and dimensions to each other. Also, two or more channel structures 32 of knitted component 10 can have similar shape and dimensions to each other. Moreover, in some embodiments, at least one ridge structure 30 and at least one channel structure 32 can be similar in shape and dimension. In other embodiments, the shape and dimensions of ridge structures 30 and/or channel structures 32 can vary across knitted component 10. Knitted component 10 can include any suitable number of ridge structures 30 and channel structures 32. Ridge structures 30 are differentiated from channel structures 32 in FIG. 4 using different cross hatching for purposes of clarity. However, it will be appreciated that ridge structures 30 and channel structures 32 can be formed of unitary knit construction in some embodiments.

Because of ridge structures 30, respective areas of front surface 14 can project and/or can be convex. Additionally, because of ridge structures 30, respective areas of back surface 16 can be recessed and/or can be concave. In contrast, because of channel structures 32, respective areas of front surface 14 can be recessed and/or can be concave. Furthermore, because of channel structures 32, respective areas of back surface 16 can project and/or can be convex.

Figure 6:
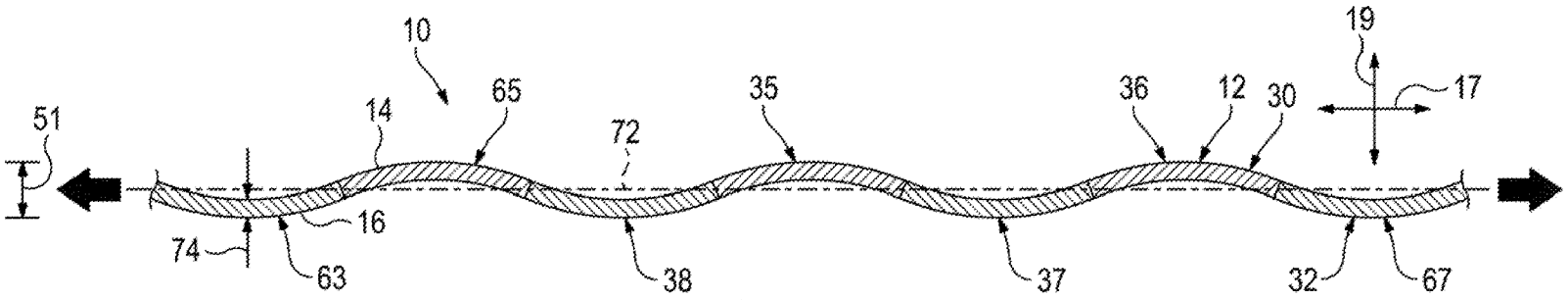
FIG. 6 is a cross section of the knitted component of FIG. 1 shown in a third position in which the knitted component has been further stretched compared to the second position of FIGS. 2 and 5.

As mentioned, knitted component 10 can be resiliently flexible, compressible, and stretchable. Ridge structures 30 and/or channel structures 32 can flex, deform, or otherwise move as knitted component 10 stretches. In the first position of FIGS. 1 and 4, ridge structures 30 and channel structures 32 can exhibit a large degree of curvature and can be relatively compact. In the second or stretched position of FIGS. 2 and 5, ridge structures 30 and channel structures 32 can be more extended and flattened. In some embodiments, knitted component 10 can also stretch to a third position as illustrated in FIG. 6. As shown in FIG. 6, knitted component 10 as well as ridge structures 30 and channel structures 32 can flatten and extend out to an even larger extent than the second position illustrated in FIGS. 2 and 5.

The first position of knitted component 10 shown in FIGS. 1 and 4 can also be referred to as a neutral position or a compacted position in some embodiments. The second position represented in FIGS. 2 and 5 can also be referred to as a deformed position, as a stretched position, or as an extended position. The third position represented in FIG. 6 can be referred to as a further deformed position, as a further stretched position, or as a further extended position.

Once knitted component 10 is stretched to the second or third position, the resilience and elasticity of knitted component 10 can allow knitted component 10 to recover and move back toward the first position represented in FIGS. 1 and 4. Stated differently, knitted component 10 can be biased toward the first position.

As shown in FIG. 3, movement of knitted component 10 from the first position to the second position can cause knitted component 10 to stretch and elongate in the lateral direction 17 in some embodiments. More specifically, as shown in FIG. 3, knitted component 10 can have a first length 39 in the first position, measured from third edge 24 to fourth edge 26 along lateral direction 17. In contrast, knitted component 10 can have a second length 41, which is longer than first length 39, in the second position. It will be appreciated that knitted component 10 can have an even longer length when in the third position represented in FIG. 6.

Knitted component 10 can also have a width 45 that is measured between first edge 20 and second edge 22 along longitudinal direction 15. In some embodiments, width 45 can remain substantially constant as knitted component 10 moves between the first position, second, and third positions. Also, in some embodiments, knitted component 10 can exhibit some stretchability in the longitudinal direction 15 such that width 45 is variable. However, knitted component 10 can exhibit a significantly higher degree of stretchability in the lateral direction 17 than in the longitudinal direction 15 in some embodiments.

Furthermore, knitted component 10 can have a body thickness that changes as knitted component 10 moves. Specifically, as shown in FIG. 3, knitted component 10 can have a first body thickness 47 in the first position, and knitted component 10 can have a second, reduced body thickness 49 in the second position. As shown in FIG. 6, knitted component 10 can additionally have a third body thickness 51 in the third position, and third body thickness 51 can be less than the first body thickness 47 and the second body thickness 49. It will be appreciated that the body thickness changes because the curvature of ridge structures 30 and channel structures 32 changes as knitted component 10 stretches.

Embodiments of wave features 12, ridge structures 30, and channel structures 30 will now be discussed in greater detail according to exemplary embodiments. As shown in FIG. 4, ridge structures 30 can have corresponding shape to the channel structures 32; however, ridge structures 30 can be inverted relative to channel structures 32. Also, as shown in FIG. 4, ridge structures 30 and channel structures 32 can be disposed on opposite sides of an imaginary reference plane 72 in some embodiments.

The plurality of ridge structures 30 can include a first ridge structure 35. In some embodiments, first ridge structure 35 can be representative of others of the plurality of ridge structures 30. First ridge structure 35 can have an inverted U-shape in some embodiments. More specifically, as shown in FIG. 5, first ridge structure 35 can include an apex 40, a first side wall 42, and a second side wall 44. Apex 40 can be rounded in some embodiments. In other embodiments, apex 40 can be flat or angular. First side wall 42 and second side wall 44 can extend away from each other in a downward direction from apex 40. First side wall 42 and/or second side wall 44 can be rounded in some embodiments. In other embodiments, first side wall 42 and/or second side wall 44 can be substantially planar. First side wall 42 can define a first edge 46 of ridge structure 35, and second side wall 44 can define a second edge 48 of ridge structure 35. First ridge structure 35 can also be concave on back surface 16, and first ridge structure 35 can define an opening 43 between first side wall 42, second side wall 44, and apex 40.

Also, the plurality of channel structures 32 can include a first channel structure 37. In some embodiments, first channel structure 37 can be representative of others of the plurality of channel structures 32. First channel structure 37 can have a U-shape in some embodiments. More specifically, as shown in FIG. 5, first channel structure 37 can include a nadir 54, a first side wall 56, and a second side wall 58. Nadir 54 can be rounded in some embodiments. In other embodiments, nadir 54 can be flat or angular. First side wall 56 and second side wall 56 can extend away from each other in an upward direction from nadir 54. First side wall 56 and/or second side wall 58 can be rounded in some embodiments. In other embodiments, first side wall 56 and/or second side wall 58 can be substantially planar. First side wall 56 can define a first edge 60 of channel structure 37, and second side wall 58 can define a second edge 62 of channel structure 37. First channel structure 37 can also be concave on front surface 14, and first channel structure 37 can define an opening 57 between first side wall 56, second side wall 58, and nadir 54.

In some embodiments, ridge structures 30 and channel structures 32 can be elongate and substantially straight as shown in FIGS. 1 and 2. More specifically, ridge structures 30 can extend longitudinally along a respective ridge axis 79, one of which is indicated in FIG. 1 as an example. Ridge structures 30 can have a first longitudinal end 50 and a second longitudinal end 52 as shown in FIG. 1. Similarly, channel structures 32 can extend longitudinally along a respective channel axis 81, one of which is indicated in FIG. 1 as an example. Channel structures 32 can include a first longitudinal end 64 and a second longitudinal end 66 as shown in FIG. 1. In some embodiments, ridge axis 79 and channel axis 81 can be substantially straight and parallel to the longitudinal direction 15. In other embodiments, ridge axis 79 and/or channel axis 81 can be curved. Also, in some embodiments, ridge structures 30 and channel structures 32 can be nonparallel relative to each other.

Additionally, in some embodiments shown in FIG. 2, first longitudinal ends 50 of ridge structures 30 can be disposed proximate first edge 20 of knitted component 10, and second longitudinal ends 52 of ridge structures 30 can be disposed proximate second edge 22 of knitted component 10. Likewise, first longitudinal ends 64 of channel structures 32 can be disposed proximate to first edge 20 of knitted component 10, and second longitudinal ends 66 of channel structures 32 can be disposed proximate to second edge 22 of knitted component. Furthermore, in some embodiments, first longitudinal ends 50 of ridge structures 30 and first longitudinal ends 64 of channel structures 32 can cooperate to define first edge 20 of knitted component 10. Similarly, second longitudinal ends 52 of ridge structures 30 and second longitudinal ends 66 of channel structures 32 can cooperate to define second edge 22 of knitted component 10 in some embodiments.

Ridge structures 30 and channel structures 32 can be spaced apart relative to each other. For example, ridge structures 30 and channel structures 32 can be spaced apart in the lateral direction 17 in some embodiments. Also, in some embodiments, ridge structures 30 and channel structures 32 can be arranged in an alternating pattern across knitted component 10. More specifically, as shown in FIGS. 4 and 5, the plurality of ridge structures 30 can include a first ridge structure 35 as well as a second ridge structure 36 that are adjacent each other. Likewise, the plurality of channel structures 32 can include a first channel structure 37 as well as a second channel structure 37 that are adjacent each other. First channel structure 37 can be disposed between and can separate first ridge structure 35 and second ridge structure 36. Furthermore, first ridge structure 35 can be disposed between and can separate first channel structure 37 and second channel structure 38. This alternating arrangement can be repeated, for example, across knitted component 10 in the lateral direction 17. For example, in some embodiments, such as the embodiment shown in FIGS. 1, 2, 4, and 5, knitted component 10 can further include a third ridge structure 61, a third channel structure 63, a fourth ridge structure 65, a fourth channel structure 67, and a fifth ridge structure 69. As shown, third ridge structure 61 can define third edge 24 of knitted component 10. Moving away from third edge 24 in lateral direction 17, third channel structure 63 can be disposed adjacent to third ridge structure 61. Also, fourth ridge structure 65 can be disposed adjacent third channel structure 63, and second channel structure 38 can be disposed adjacent fourth ridge structure 65. As stated, first ridge structure 35 can be disposed adjacent second channel structure 38, first channel structure 37 can be disposed adjacent first ridge structure 35, and second ridge structure 36 can be disposed adjacent first channel structure 37. Additionally, fourth channel structure 67 can be disposed second ridge structure 36, and fifth ridge structure 69 can be disposed adjacent fourth channel structure 67. Fifth ridge structure 69 can define fourth edge 26.

Ridge structures 30 and channel structures 32 can be directly adjacent and attached to each other in some embodiments. More specifically, as shown in FIG. 5, first edge 46 of first ridge structure 35 can be attached to second channel structure 38 at a first transition 68. Also, second edge 48 of first ridge structure 35 can be attached to first edge 60 of first channel structure 37 at a second transition 70. This arrangement can be similar between the other adjacent pairs of ridge structures 30 and channel structures 32 as well.

Movement of ridge structures 30 and channel structures 32 as knitted component 10 moves between the first position and the second position will now be discussed. As shown in FIG. 3, ridge structures 30 can be in a compacted position when knitted component 10 is in the first position, and channel structures 32 can similarly be in a compacted position. In contrast, as shown in FIG. 5, ridge structures 30 can be in an extended position when knitted component 10 is in the second position, and channel structures 32 can similarly be in an extended position. First side wall 42 and second side wall 44 of the ridge structures 30 can be closer together in the compacted position as compared to the extended positions. Likewise, first side wall 56 and the second side wall 58 of the channel structures 32 can be closer together in the compacted position as compared to the extended positions. Still further, the first transitions 68 can be closer to the second transitions 70 in the compacted position as compared to the extended positions. Additionally, the apex 40 and the nadir 54 can have greater curvature in the compacted position as compared to the extended positions. First side wall 42 and second side wall 44 can rotate about the respective apex 40 when moving between the compacted and extended positions. Also, first side wall 56 and second side wall 58 can rotate about the respective nadir 54 when moving between the compacted and extended positions.

Also, as shown in FIGS. 1 and 4, adjacent ridge structures 30 can abut each other and/or adjacent channel structures 32 can abut each other when in the compacted position. For example, in some embodiments, first ridge structure 35 and second ridge structure 36 can abut along front surface 14 in the compacted position represented in FIGS. 1 and 4, and first channel structure 37 and second channel structure 38 can also abut along back surface 16 in the compacted position. Other adjacent pairs of ridge structures 30 can similarly abut in the compacted position represented in FIGS. 1 and 4. Likewise, other adjacent pairs of channel structures 32 can abut in this position.

However, as shown in FIGS. 2 and 5, adjacent ridge structures 30 can move away from each other as knitted component 10 moves to the second, extended position so that adjacent ridge structures 30 no longer abut. Adjacent channel structures 32 can similarly move away from each other such that adjacent channel structures 32 no longer abut as knitted component 10 moves to the second, extended position represented in FIGS. 2 and 5.

Additionally, in some embodiments, ridge structures 30 and/or channel structures 32 can be biased toward the compacted position represented in FIGS. 1 and 4. Accordingly, in some embodiments, ridge structures 30 and channel structures 32 can be forced to move toward the extended position represented in FIGS. 2 and 5, and once the stretching force is reduced, ridge structures 30 and channel structures 32 can recover back to the compacted position represented in FIG. 4. In some embodiments, abutment between ridge structures 30 and channel structures 32 can limit movement of knitted component away from the extended position of FIGS. 2 and 5 and toward the compacted position of FIGS. 1 and 4.

In some embodiments, ridge structures 30 can be biased to curl, roll, fold, or otherwise contract in a first direction toward the compacted position of FIG. 4. More specifically, as shown in FIG. 5, ridge structures 30 can be biased to curl in the first direction about the respective ridge axis 79 as indicated by arrows 78. In contrast, channel structures 32 can be biased to curl, roll, fold, or otherwise contract in a second, opposite direction toward the compacted position of FIG. 4. More specifically, as shown in FIG. 5, channel structures 32 can be biased to curl in a second direction about the respective channel axis 81 as indicated by arrows 80. Thus, in some embodiments, ridge structures 30 can be biased to "curl under" in the first direction 78 such that first side wall 42 and second side wall 44 curl and move toward each other on back surface 16. In contrast, channel structures 32 can be biased to "curl up" in the second, opposite direction 80 such that first side wall 56 and second side wall 58 curl and move toward each other on front surface 14.

Thus, when knitted component 10 is at rest and/or unloaded, knitted component 10 can be disposed in the position shown in FIG. 4 in some embodiments. Then, when pulled in the lateral direction 17, ridge structures 30 and channel structures 32 can unroll, uncurl, unfold, or otherwise move toward the extended position shown in FIG. 5. Further pulling can cause further movement toward the extended position shown in FIG. 6. When the load is removed, the resilience of knitted component 10 and biasing provided by ridge structures 30 and channel structures 32 can cause recovery of knitted component 10 back to the position of FIG. 4.

Furthermore, as shown in FIG. 7, when knitted component 10 is compressed, one or more ridge structures 30 and/or channel structures 32 can move away from the respective compacted position toward the respective extended position. In the embodiments of FIG. 7, the compression load is indicated schematically by arrows 82. Compression load can be applied between front surface 14 and back surface 16. Under the influence of compression load, one or more ridge structures 30 and/or one or more channel structures 32 can move away from the respective compacted position toward the respective extended position. Upon removal or reduction of the compression load, the deformed ridge structure(s) 30 and/or channel structure(s) 32 can recover back to the respective compacted position. It will be appreciated that knitted component 10 can cushion, attenuate, or otherwise reduce the compression load due to this resilience.

Knit Construction and Manufacture of Knitted Component

Figure 8:
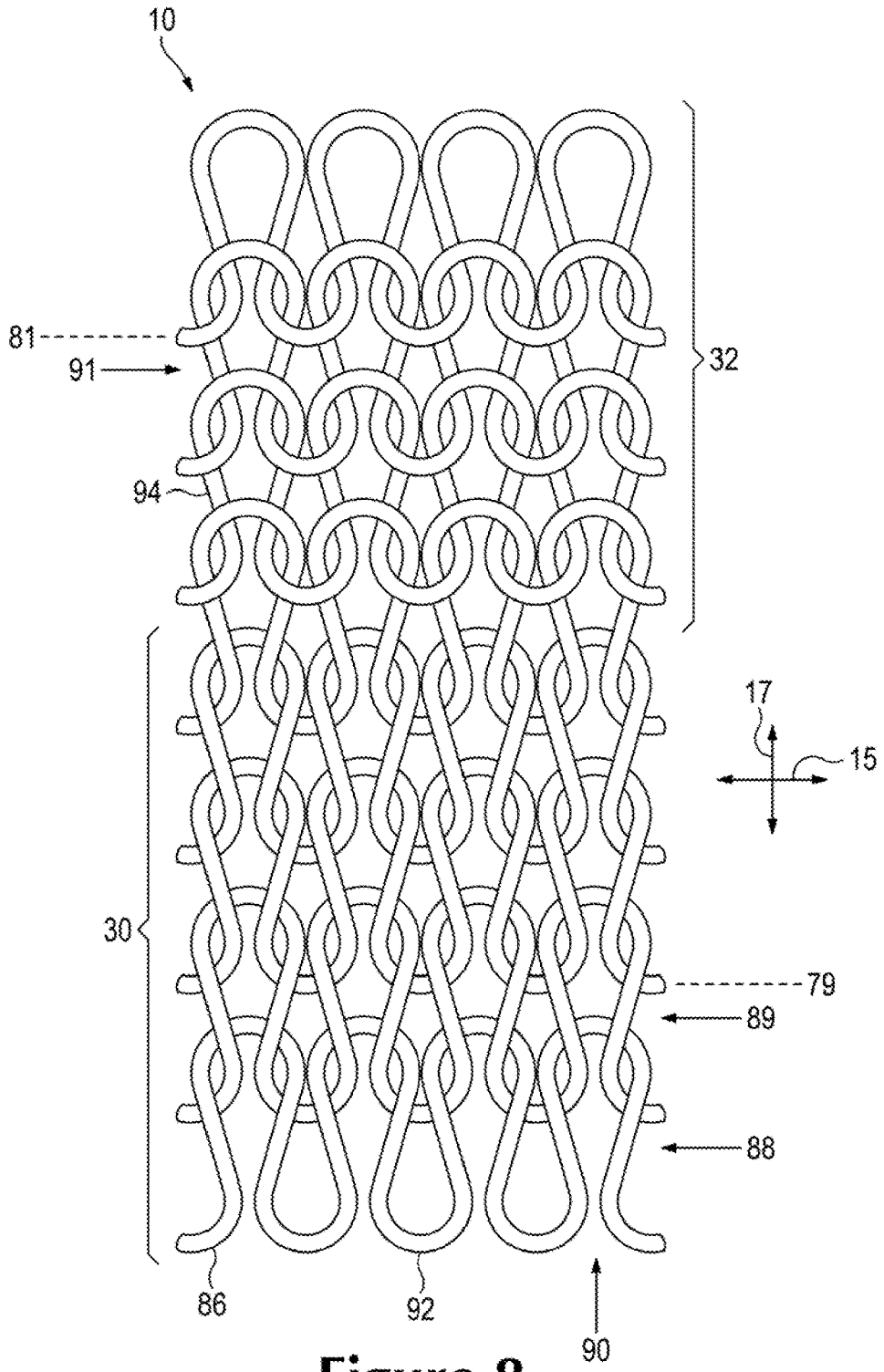
FIG. 8 is a detail view of the knitted component of FIG. 1 according to exemplary embodiments.

Referring now to FIG. 8, a portion of knitted component 10 is illustrated in detail according to exemplary embodiments. As shown, knitted component 10 can include one or more yarns, cables, fibers, strands, monofilaments, compound filaments, or other yarns 86 that are knitted to define knitted component 10. Yarn 86 can be knitted and stitched to define a plurality of successive courses 88 and a plurality of successive wales 90. In some embodiments, courses 88 can extend generally in the longitudinal direction 15, and wales 90 can extend generally in the lateral direction 17.

A representative ridge structure 30 and a representative channel structure 32 are also indicated in FIG. 8. As shown, the plurality of courses 88 of knitted component 10 can include a plurality of ridge courses 89 that define ridge structure 30. Also, as shown, the plurality of courses 88 of knitted component 10 can include a plurality of channel courses 91 that define channel structure 32. In some embodiments, ridge courses 89 can extend in the same direction as ridge axis 79, and channel courses 91 can extend in the same direction as channel axis 81.

As shown in FIG. 8, the knit stitch structure of the ridge structure 30 can be opposite the knit stitch structure of channel structure 32. For example, as shown in FIG. 8, the ridge structure 30 can be knitted using a front jersey knit structure, and the channel structure 32 can be knitted using a reverse jersey knit structure. This pattern is also represented schematically in FIG. 10. In other embodiments, the ridge structure 30 can be knitted using a reverse jersey knit structure, and the channel structure 32 can be knitted using a front jersey knit structure. It will be appreciated that the inherent biasing provided by this type of knit stitch structure can at least partially cause the biased curling, rolling, folding, or compacting behavior of the ridge structure 30 and channel structure 32. Also, it will be appreciated that because ridge structure 30 is stitched in an opposite configuration from channel structure 32, ridge structure 30 and channel structure 32 can be biased to curl in opposite directions.

It will be appreciated that ridge structure 30 can include any number of ridge courses 89, and channel structure 32 can include any number of channel courses 91. In some embodiments, such as the embodiment of FIG. 8, ridge structure 30 includes four ridge courses 89, and channel structure 32 can include four channel courses 91. However, the number of ridge courses 89 and channel courses 91 can be different from the embodiment of FIG. 8. In other embodiments, ridge structure 30 can include six to ten ridge courses 89, and channel structure 32 can include six to ten channel courses 91. Also, the curvature of ridge structure 30 can be affected by the number of ridge course 89 that are included, and the curvature of channel structure 32 can be affected by the number of channel courses 91 that are included. More specifically, by increasing the number of ridge courses 89, the curvature of ridge structure 30 can be increased. Likewise, by increasing the number of channel courses 91, the curvature of channel structure 32 can be increased. The number of ridge courses 89 within ridge structure 30 can be chosen to provide enough fabric to allow ridge structure 30 to sufficiently curl. The number of channel courses 91 within channel structure 32 can be chosen to provide enough fabric to allow channel structure 32 to sufficiently curl. Additionally, the number of ridge courses 89 and channel courses 91 can be chosen to allow adjacent ridge structures 30 and adjacent channel structures 32 to abut when in the position of FIGS. 1 and 4.

Moreover, in some embodiments, yarn 86 can be made from a material or otherwise constructed to enhance the resiliency of the ridge structures 30 and channel structures 32. Yarns 86 can be made out of any suitable material, such as cotton, elastane, polymeric material, or combinations of two or more materials. Also, in some embodiments, yarn 86 can be stretchable and elastic. As such, yarn 86 can be stretched considerably in length and can be biased to recover to its original, neutral length. In some embodiments, yarn 86 can stretch elastically to increase in length at least 25% from its neutral length without breaking. Furthermore, in some embodiments, yarn 86 can elastically increase in length at least 50% from its neutral length. Moreover, in some embodiments, yarn 86 can elastically increase in length at least 75% from its neutral length. Still further, in some embodiments, yarn 86 can elastically increase in length at least 100% from its neutral length. Accordingly, the elasticity of yarn 86 can enhance the overall resilience of knitted component 10.

Additionally, in some embodiments, knitted component 10 can be knitted using a plurality of different yarns. For example, in some embodiments represented in FIG. 8, at least one ridge structure 30 can be knitted using a first yarn 92, and at least one channel structure 32 can be knitted using a second yarn 94. In some embodiments, first yarn 92 and second yarn 94 can differ in at least one characteristic. For example, first yarn 92 and second yarn 94 can differ in appearance, diameter, denier, elasticity, texture, or other characteristic. In some embodiments, for example, first yarn 92 and second yarn 94 can differ in color. Thus, in some embodiments, when a viewer is looking at front surface 14 when knitted component 10 is in the first position of FIGS. 1 and 4, first yarn 92 can be visible and second yarn 94 can be hidden from view. Then, when knitted component 10 stretches to the position of FIGS. 2 and 5, and 6, second yarn 94 can be revealed. Thus, the appearance of knitted component 10 can vary, and yarns 92 and 94 can provide striking visual contrast that is aesthetically appealing.

In some embodiments, first yarn 92 can be knitted to form multiple ridge structures 30. Second yarn 94 can be used to form multiple channel structures 32 in some embodiments. Also, as shown in FIG. 2, first yarn 92 can include one or more first bridge portions 96, and second yarn 94 can include one or more second bridge portions 98. First bridge portion 96 can be a portion of first yarn 92 that is excluded from all knitted loops of knitted component 10 and extends between adjacent ridge structures 30 and across a channel structure 32 disposed between those adjacent ridge structures 30, such that first bridge portion 96 limits an extended portion of channel structure 32. In contrast, second bridge portion 98 can be a portion of second yarn 94 that is excluded from all knitted loops of knitted component 10 and extends between adjacent channel structures 32 and across a ridge structure 30 disposed between those adjacent channel structures 32, such that second bridge portion 98 limits an extended position of ridge structure 30. For example, as shown in the embodiment of FIG. 2, first yarn 92 can be knitted to define first ridge structure 35 and second ridge structure 36, and first bridge portion 96 of yarn 92 can freely extend across first channel structure 37. Additional first bridge portions 96 can extend across other channel structures 32 as well as shown in FIG. 2. Moreover, as shown in the embodiment of FIG. 2, second yarn 94 can be knitted to define first channel structure 37 and second channel structure 38, and second bridge portion 98 of yarn 94 can freely extend across first ridge structure 35. Additional second bridge portions 98 can extend across other ridge structures 30 as shown in FIG. 2. Furthermore, in some embodiments, first bridge portions 96 and second bridge portions 98 can be spaced apart and can be disposed on opposite edges of knitted component 10. For example, in some embodiments, first bridge portions 96 can be disposed proximate second edge 22 of knitted component 10, and second bridge portions 98 can be disposed proximate first edge 20 of knitted component 10.

Knitted component 10 can be manufactured using any suitable machine, implement, and technique. For example, in some embodiments, knitted component 10 can be automatically manufactured using a knitting machine, such as the knitting machine 250 shown in FIG. 9. Knitting machine 250 can be of any suitable type, such as a flat knitting machine. However, it will be appreciated that knitting machine 250 could be of another type without departing from the scope of the present disclosure.

Figure 9:
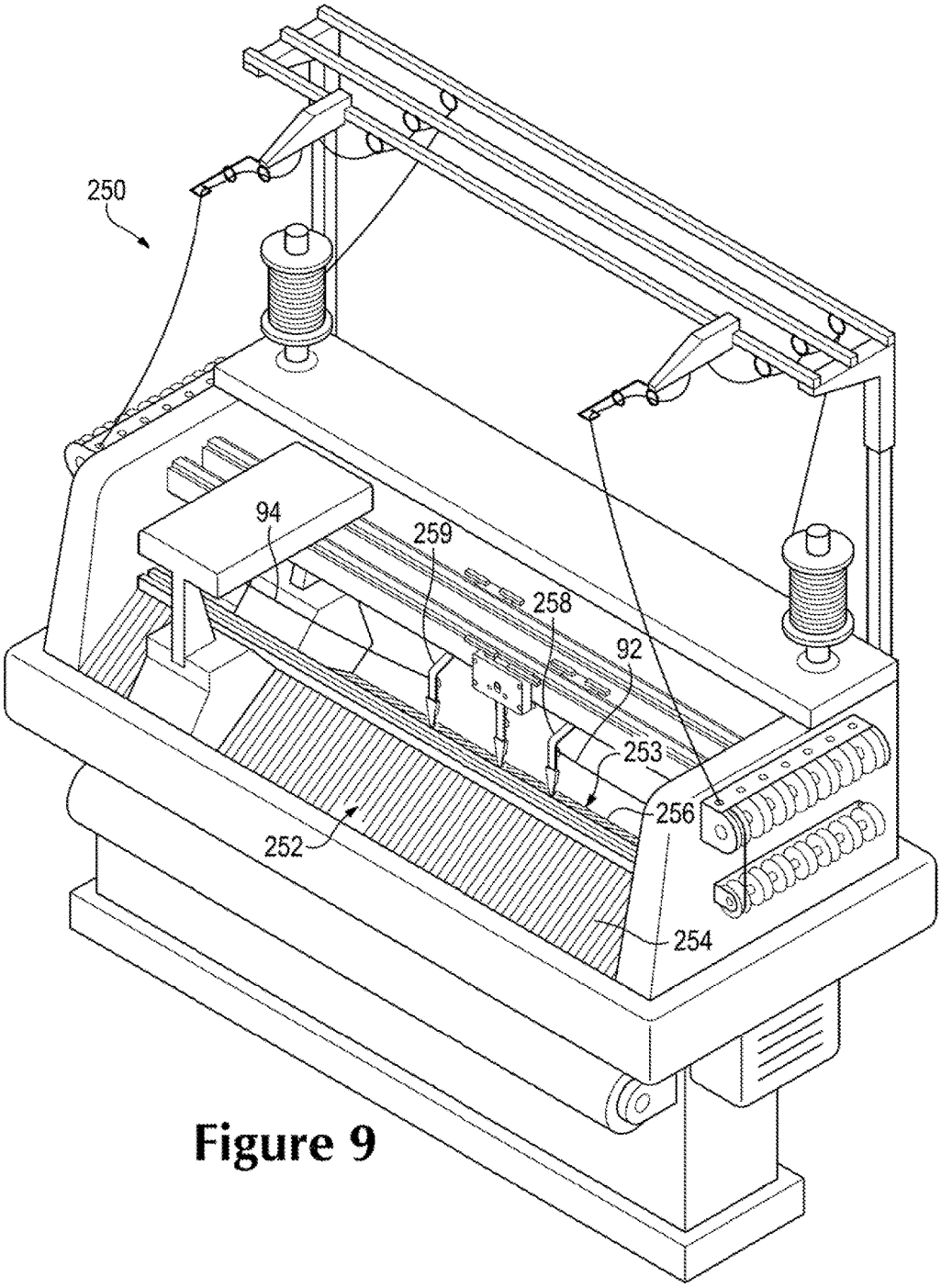
FIG. 9 is a schematic perspective view of a knitting machine configured for manufacturing the knitted component of FIG. 1.

As shown in the embodiment of FIG. 9, knitting machine 250 can include a front needle bed 252 with a plurality of front needles 254 and a rear needle bed 253 with a plurality of rear needles 256. Front needles 254 can be arranged in a common plane, and rear needles 256 can be arranged in a different common plane that intersects the plane of front needles 254. Knitting machine 250 can further include one or more feeders that are configured to move over front needle bed 252 and rear needle bed 253. In FIG. 9, a first feeder 258 and a second feeder 259 are indicated. As first feeder 258 moves, first feeder 258 can deliver first yarn 92 to needles 254 and/or needles 256 for knitting knitted component 10. As second feeder 259 moves, second feeder 259 can deliver second yarn 94 to needles 254 and/or needles 256.

In some embodiments, ridge structure 30 can be formed using the front needles 254 of front needle bed 252 whereas channel structure 32 can be formed using the rear needles 256 of rear needle bed 253. In other embodiments, ridge structure 30 can be formed using the rear needles 256 of rear needle bed 253 whereas channel structure 32 can be formed using the front needles 254 of front needle bed 252.

Figure 10:
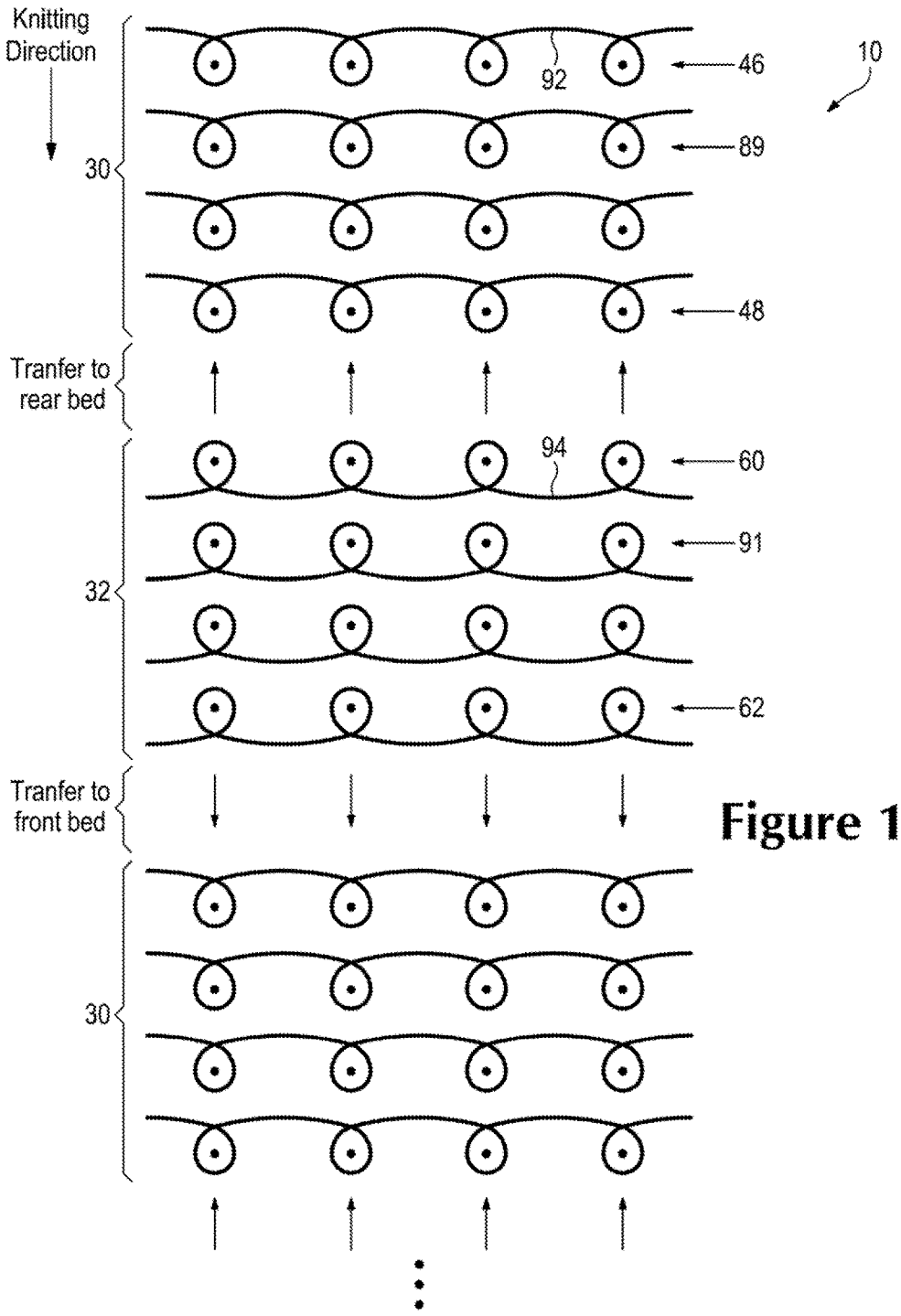
FIG. 10 is a schematic knitting diagram of the knitted component of FIG. 1.

FIG. 10 illustrates this process in greater detail according to an exemplary embodiment. A downward knitting direction is indicated in FIG. 10 for reference purposes. As shown, ridge structure 30 represented at the top of FIG. 10 can be formed using front needles 254 of front needle bed 252 using a front jersey knit structure.

Then, after formation of second edge 48 of ridge structure 30, second edge 48 can be transferred to rear needles 256 of rear needle bed 253. Next, first edge 60 of channel structure 32 can be formed and stitched to second edge 48 of ridge structure 30 using rear needles 256 in a reverse jersey knit structure. Successive channel courses 91 can then be similarly added to define channel structure 32. Subsequently, an additional ridge structure 30 can be added using front needles 254 of front needle bed 252, and so on until knitted component 10 is formed. It will be appreciated that, in this embodiment, rear needles 256 of rear needle bed 253 can remain unused during the formation of ridge structure 30, and front needles 254 of front needle bed 252 can remain unused during formation of channel structure 32.

FIGS. 11-16 further illustrate the process of knitting knitted component 10. FIGS. 11-16 can correspond to the diagram shown in FIG. 10.

Figure 11:
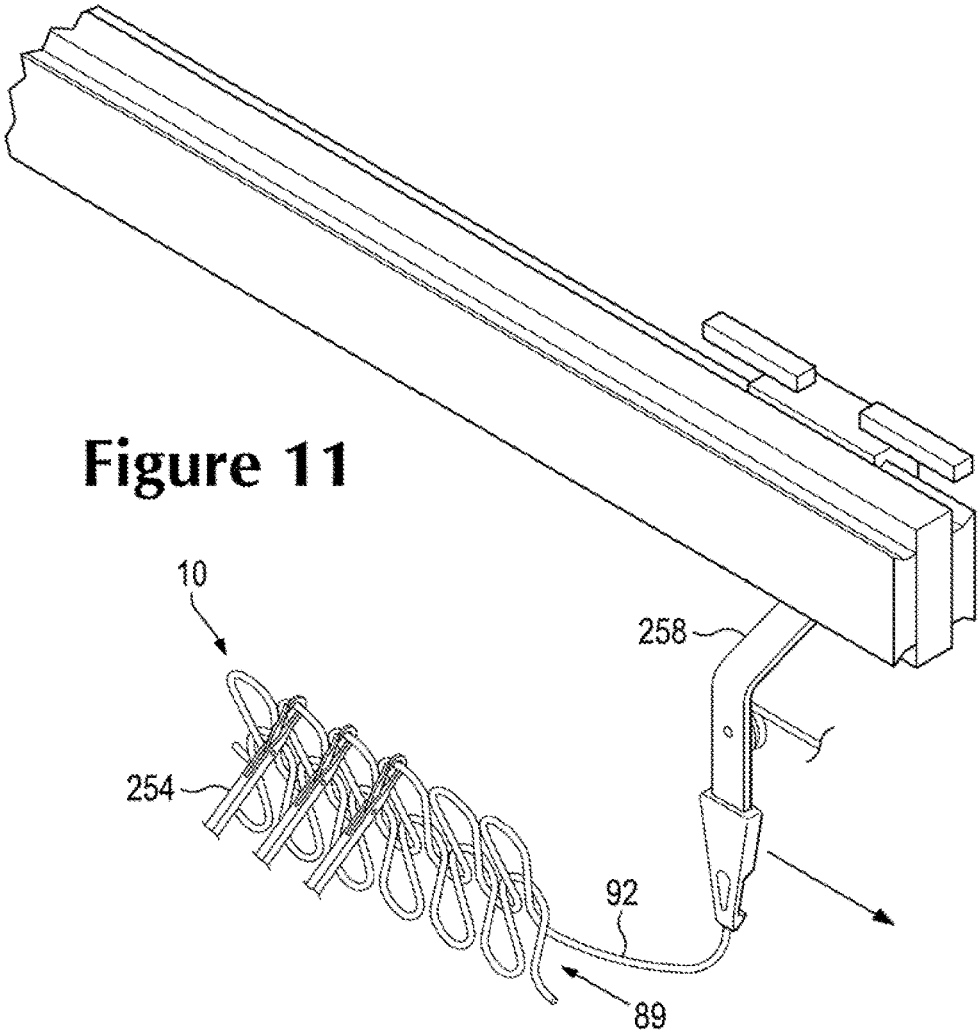
FIG. 11 is a schematic illustration of an exemplary method of manufacturing the knitted component of FIG. 1, wherein a ridge structure is shown being formed.
Figure 12:
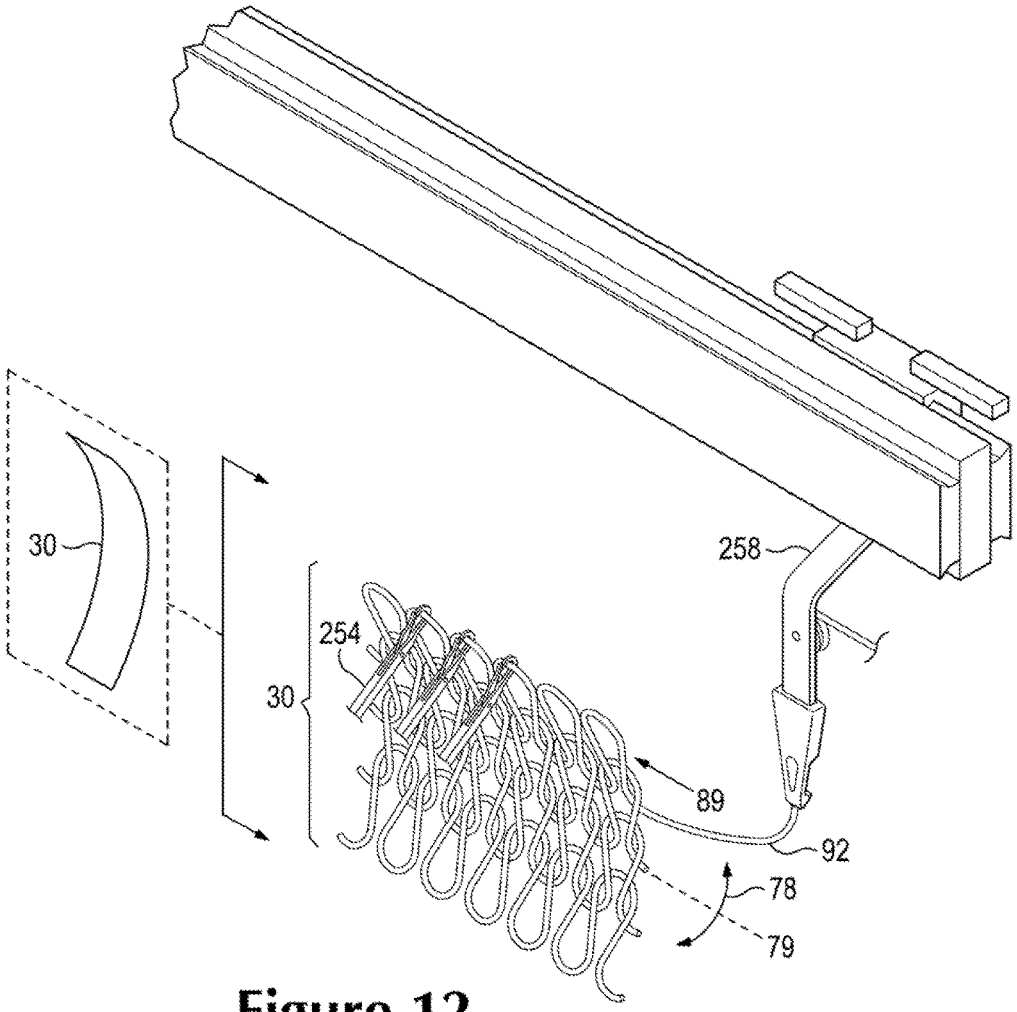
FIG. 12 is a schematic illustration of the method of manufacturing, wherein additional courses are being added to the ridge structure of FIG. 11.

Referring to FIG. 11, the knitting process can begin with feeder 258 moving and feeding yarn 92 to front needles 254. Only three of the front needles 254 are shown for purposes of clarity. Front needles 254 can receive yarn 92 and form loops that define ridge course 89. In FIG. 11, two ridge courses 89 are shown. The process can continue as shown in FIG. 12, where a third and fourth ridge course 89 have been added. As shown, ridge structure 30 can exhibit biased curling in the first direction 78 as described above due to this construction. A schematic view of the ridge structure 30 is also inset within FIG. 12 to further illustrate the curling of the ridge structure 30.

Figure 13:
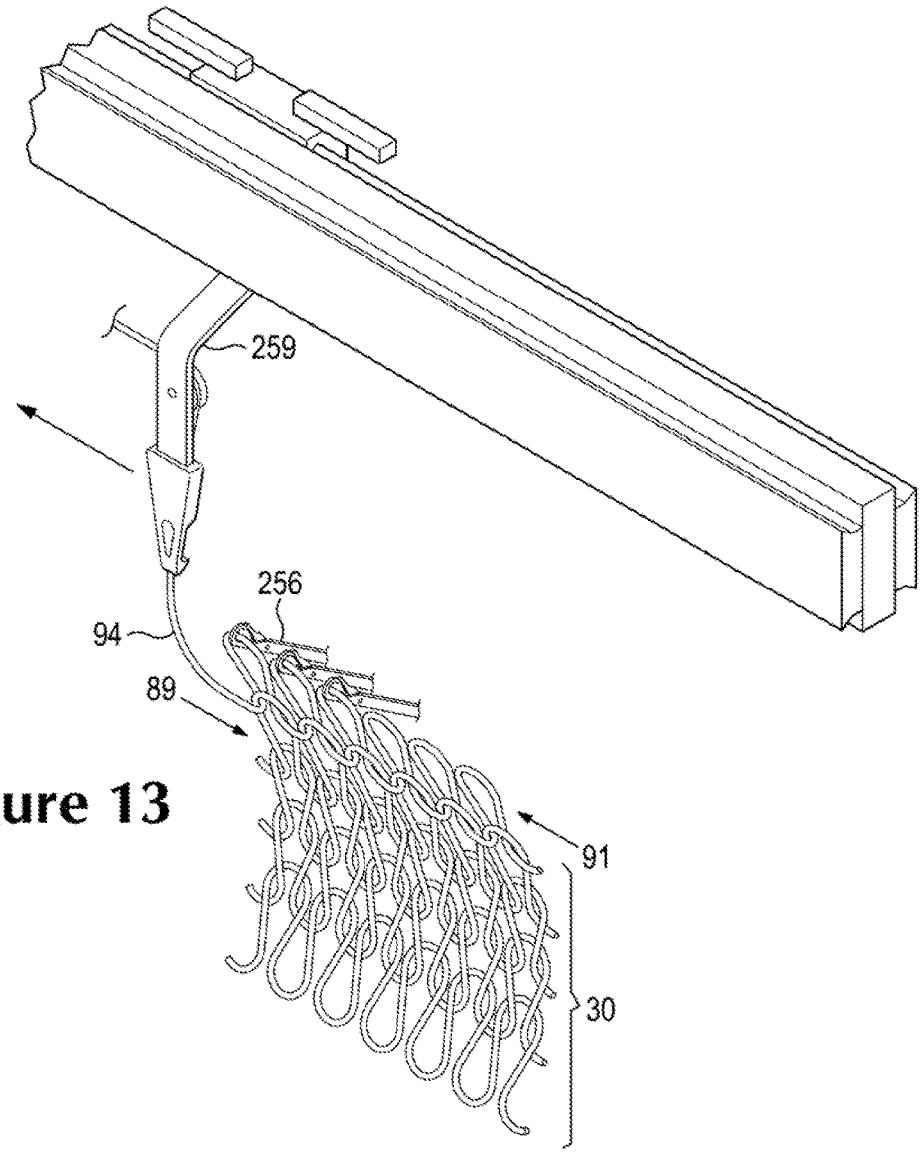
FIG. 13 is a schematic illustration of the method of manufacturing, wherein a channel structure is shown being formed onto the ridge structure of FIG. 12.
Figure 14:
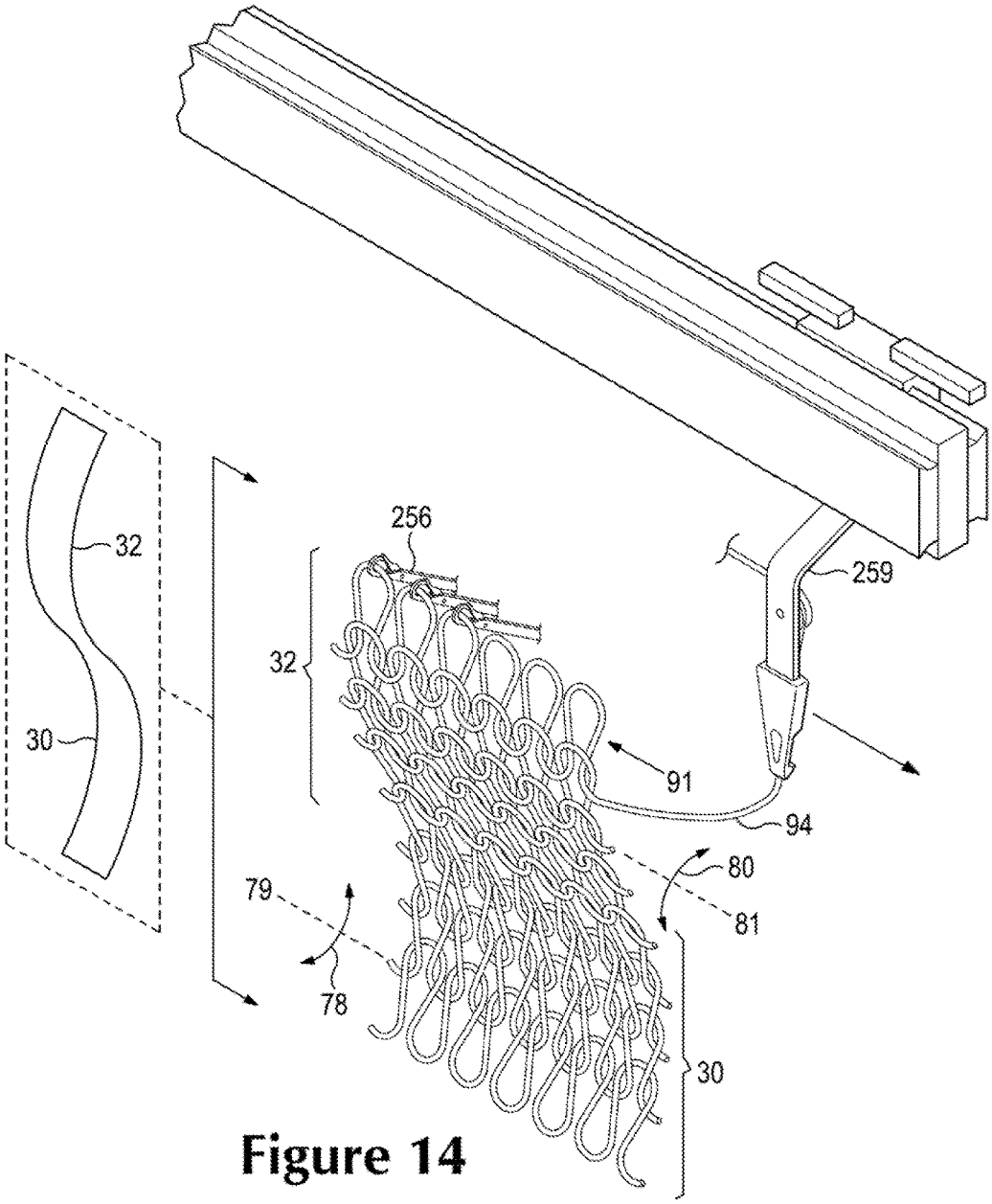
FIG. 14 is a schematic illustration of the method of manufacturing, wherein additional courses are being added to the channel structure of FIG. 13.

Next, as shown in FIG. 13, second feeder 259 can move and feed yarn 94 to rear needles 256. Only three of the rear needles 256 are shown for purposes of clarity. Rear needles 256 can receive yarn 94 and form loops of a channel course 91 onto the channel structure 30. Subsequently, as shown in FIG. 14, additional channel courses 91 can be added to form channel structure 32. As shown, channel structure 32 can exhibit biased curling in the second direction 78 as described above due to this construction. A schematic view of channel structure 32 is also inset within FIG. 14 to further illustrate this curling of channel structure 32.

Figure 15:
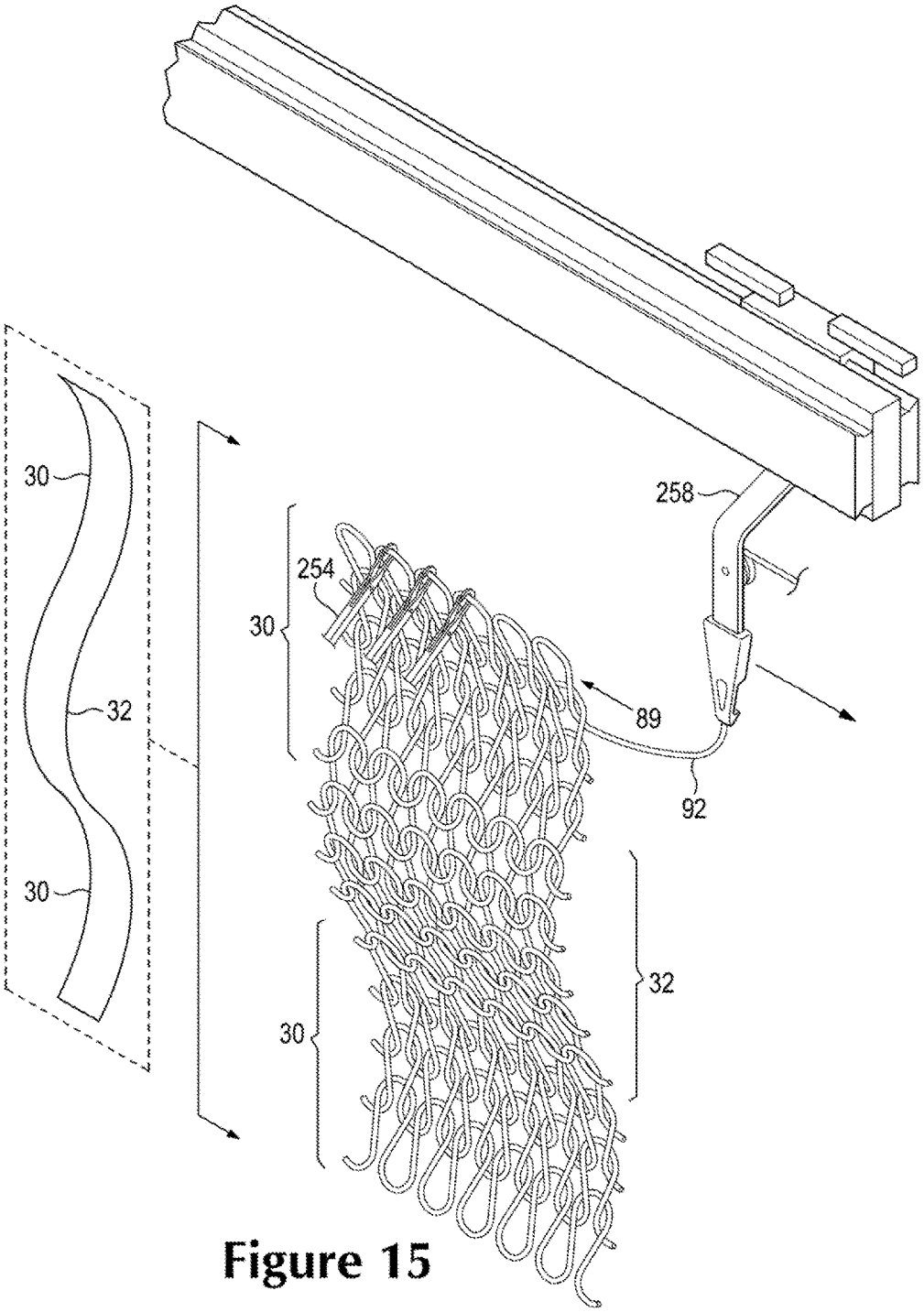
FIG. 15 is a schematic illustration of the method of manufacturing, wherein an additional ridge structure is being added.
Figure 16:
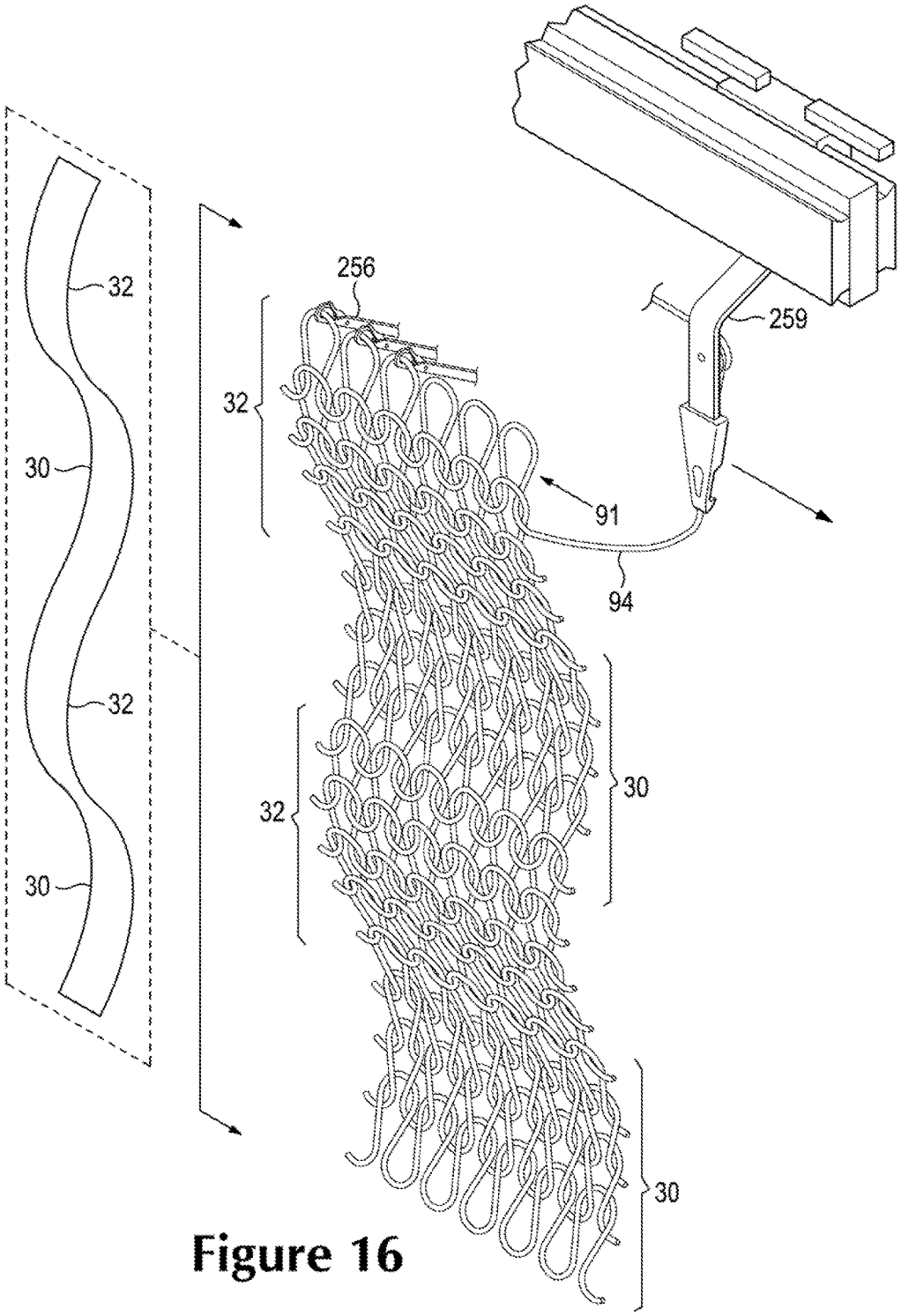
FIG. 16 is a schematic illustration of the method of manufacturing, wherein an additional channel structure is being added.

Next, as shown in FIG. 15, successive ridge courses 89 can be added to form an additional ridge structure 30. Then, as shown in FIG. 16, successive channel courses 91 can be added to form an additional channel structure 32. This process can be continued and the desired amount of ridge structures 30 and channel structures 32 can be formed until knitted component 10 is complete.

It will be appreciated that ridge structure 30 can include any suitable number of ridge courses 89 and channel structure 32 can include any suitable number of channel courses 91. The number of courses can be selected to affect the size, curling, and/or other characteristics of ridge structure 30 and channel structure 32. In some embodiments, ridge structure 30 can include at least four ridge courses 89, and/or channel structure 32 can include at least four channel courses 91. In additional embodiments, ridge structure 30 can include five to ten ridge courses 89, and/or channel structure 32 can include five to ten channel courses 91. Moreover, in some embodiments, ridge structure 30 can include six to eight ridge courses 89, and/or channel structure 32 can include six to eight channel courses 91. Additionally, in some embodiments, ridge structure 30 and channel structure 32 can include equal numbers of courses such that ridge structure 30 and channel structure 32 are approximately the same size. In other embodiments, ridge structure 30 and channel structure 32 can include different number of courses such that ridge structure 30 and channel structure 32 have different sizes. Furthermore, in some embodiments, different ridge structures 30 of knitted component 10 can include the same number of ridge courses 89. Moreover, in some embodiments, different channel structures 32 of knitted component 10 can include the same number of channel courses 91. In other embodiments, different ridge structures 30 can include different numbers of ridge courses 89, and/or different channel structures 32 can include different numbers of channel courses 91.

Accordingly, manufacture of knitted component 10 can be efficient. Also, knitted component 10 can be formed substantially without having to form a significant amount of waste material.

Figure 23:
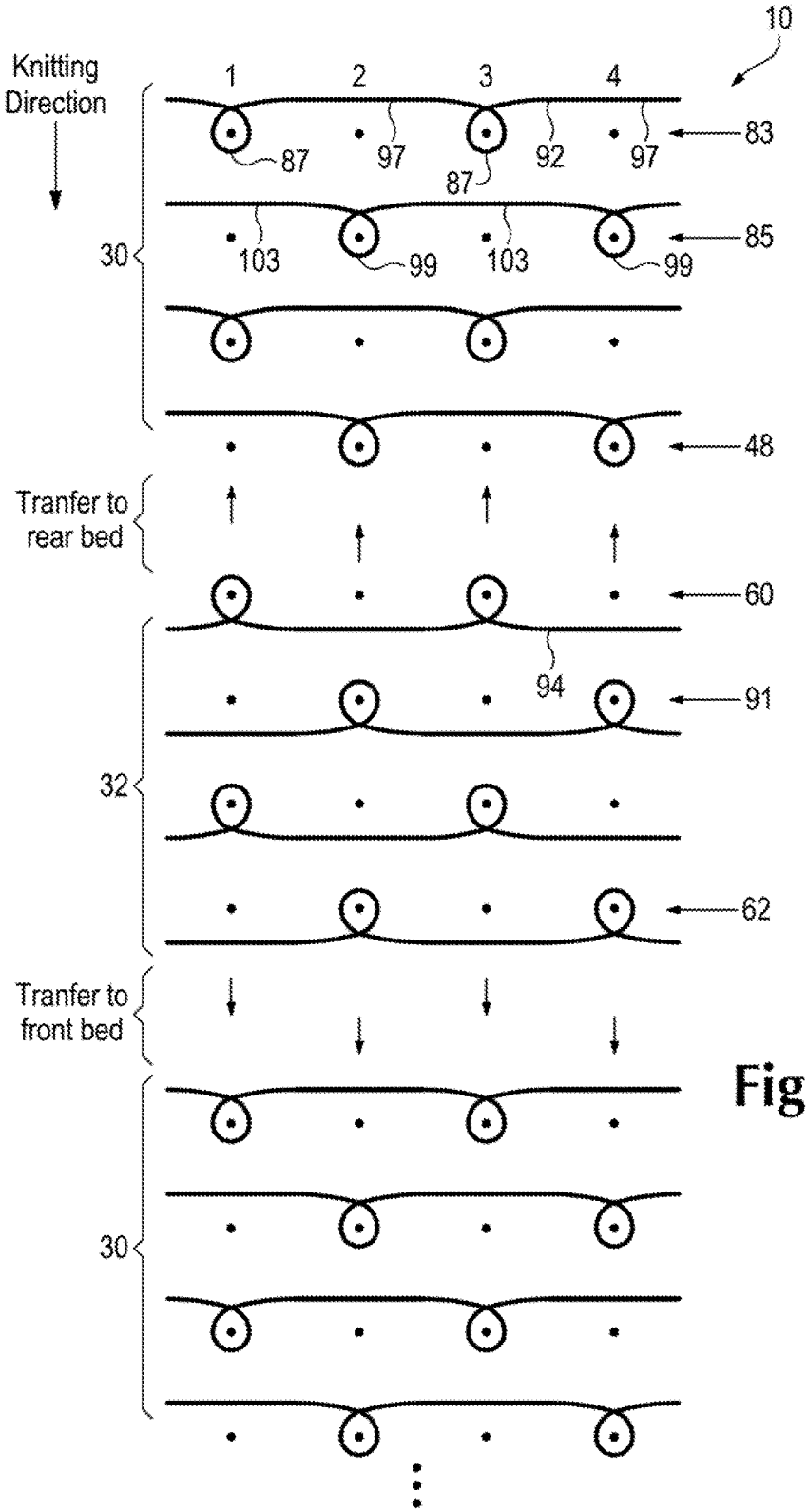
FIG. 23 is a schematic knitting diagram of the knitted component of FIG. 1 according to additional embodiments of the present disclosure.

FIG. 23 illustrates the method of manufacturing knitted component 10 according to additional exemplary embodiments. The knitting direction is indicated for reference purposes. Also, needle positions 1, 2, 3, and 4 are indicated at the top of the page for reference purposes.

Beginning at the top of FIG. 23, a first ridge course 83 can be formed. In some embodiments, first ridge course 83 can be formed with a plurality of stitches forming a plurality of first loops 87 and a plurality of floats 97. First floats 97 can be formed between respective pairs of the plurality of first loops 87. For example, first loops 87 can be formed by knitting a stitch at every other needle position and first floats 97 can be formed between the first loops 87. Thus, as shown in the illustrated embodiment, first loops 87 can be formed at needle positions 1 and 3, and first floats 97 can be formed needle positions 2 and 4.

Then, a second ridge course 85 can be formed in the next successive course. Second ridge course 85 can include a plurality of second loops 99 and a plurality of second floats 103. Second loops 99 can be formed by knitting stitches at the needle positions where first floats 97 were previously formed, and second floats 103 can be formed at the needle positions where first loops 87 were previously formed. Thus, as shown in the embodiment of FIG. 23, second floats 103 can be formed at needle positions 1 and 3, and second loops 99 can be formed at needle positions 2 and 4.

This pattern can be repeated during formation of the ridge structure 30. Then, as shown in FIG. 23, once a course corresponding to edge 48 is formed, the course defining edge 48 can be transferred to rear needles 256 of rear needle bed 253 for formation of channel structure 32.

During formation of channel structure 32, loops can be formed by knitting stitches at the needle positions where floats were previously formed, and floats can be formed at the needle positions where loops were previously formed. Thus, as shown in FIG. 23, the course defining edge 60 can include loops at needle positions 1 and 3 and floats at needle positions 2 and 4. In the next successive channel course 91, floats can be formed at needle positions 1 and 3 and loops can be formed at needle positions 2 and 4. This pattern can be repeated until channel structure 32 is formed.

Then, the previously formed course of channel structure 32 can be transferred to the front bed for formation of another ridge structure 30. Once the additional ridge structure 30 is formed, the previously formed course can be transferred to the rear bed for formation of another channel structure 32, and so on until knitted component 10 is completed.

Articles Incorporating Knitted Component

Knitted component 10 can define and/or can be included in any suitable article. These knitted components can provide resilience to the article. As such, the article can be at least partially stretchable and elastic in some embodiments. Also, the article can provide cushioning due to the knitted component 10.

Figure 17:
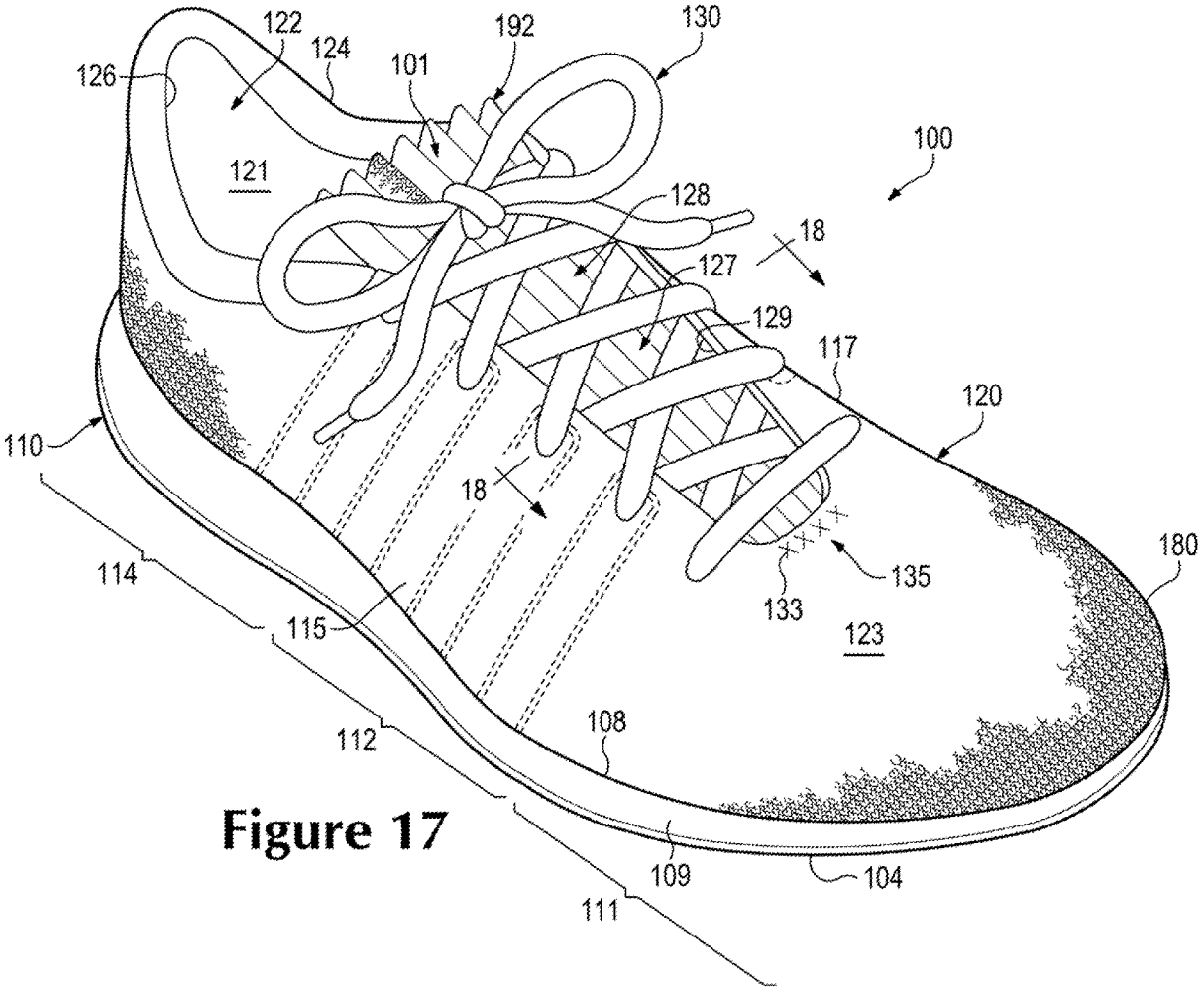
FIG. 17 is a perspective view of an article of footwear that includes a knitted component according to exemplary embodiments of the present disclosure.

For example, an article of footwear 100 is illustrated in FIG. 17. Article of footwear 100 can include a knitted component 101, which can incorporate one or more features of knitted component 10 of FIGS. 1-7.

Generally, footwear 100 can include a sole structure 110 and an upper 120. Upper 120 can receive the wearer's foot and secure footwear 100 to the wearer's foot whereas sole structure 110 can extend underneath upper 120 and support wearer.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone. Footwear 100 can also include a lateral side 115 and a medial side 117. Lateral side 115 and medial side 117 can extend through forefoot region 111, midfoot region 112, and heel region 114 in some embodiments. Lateral side 115 and medial side 117 can correspond with opposite sides of footwear 100. More particularly, lateral side 115 can correspond with an outside area of the wearer's foot—the surface that faces away from the other foot. Medial side 117 can correspond with an inside area of the wearer's foot—the surface that faces toward the other foot. Forefoot region 111, midfoot region 112, heel region 114, lateral side 115, and medial side 117 are not intended to demarcate precise areas of footwear 100. Rather, forefoot region 111, midfoot region 112, heel region 114, lateral side 115, and medial side 117 are intended to represent general areas of footwear 100 to aid in the following discussion.

Sole structure 110 can be secured to upper 120 and can extend between the wearer's foot and the ground when footwear 100 is worn. Sole structure 110 can be a uniform, one-piece member in some embodiments. Alternatively, sole structure 110 can include multiple components, such as an outsole, a midsole, and an insole, in some embodiments.

Also, sole structure 110 can include a ground-engaging surface 104. Ground-engaging surface 104 can also be referred to as a ground-contacting surface. Furthermore, sole structure 110 can include an upper surface 108 that faces the upper 120. Stated differently, upper surface 108 can face in an opposite direction from the ground-engaging surface 104. Upper surface 108 can be attached to upper 120. Also, sole structure 110 can include a side peripheral surface 109 that extends between ground engaging surface 104 and upper surface 108. Side peripheral surface 109 can also extend substantially continuously about footwear 100 between forefoot region 111, lateral side 115, heel region 114, and medial side 117.

Upper 120 can define a void 122 that receives a foot of the wearer. Stated differently, upper 120 can define an interior surface 121 that defines void 122. Upper 120 can also define an exterior surface 123 that faces in a direction opposite interior surface 121. When the wearer's foot is received within void 122, upper 120 can at least partially enclose and encapsulate the wearer's foot. Thus, upper 120 can extend about forefoot region 111, lateral side 115, heel region 114, and medial side 117 in some embodiments.

In some embodiments, upper 120 can be at least partially formed from a first knitted component 180. Examples of knitted component 180 are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al., the entire disclosure of each being incorporated herein by reference.

Upper 120 can also include a collar 124. Collar 124 can include a collar opening 126 that is configured to allow passage of the wearer's foot during insertion or removal of the foot from void 122.

Upper 120 can also include a throat 128. Throat 128 can include a throat opening 129 between lateral side 115 and medial side 117. Throat opening 129 can extend from collar opening 126 toward forefoot region 111. Throat opening 129 dimensions can be varied to change the width of footwear 100 between lateral side 115 and medial side 117 in some embodiments.

In some embodiments, upper 120 can also include a tongue 127 that is disposed within throat opening 129. Tongue 127 can include a knitted component 101 and/or can be at least partially defined by knitted component 101. Knitted component 101 can include one or more features of knitted component 10 discussed above in relation to FIGS. 1-7.

In some embodiments, tongue 127 can be an independent body with respect to adjacent areas of upper 120. Tongue 127 can also be removably attached to adjacent areas of upper 120. For example, as shown in FIG. 17, knitted component 101 can be attached to an edge of throat opening 129 at forefoot area 111 of upper 120 in some embodiments. More specifically, in some embodiments, tongue 127 can be attached at its forward end to forefoot region 111, and tongue 127 can be detached from lateral side 115 and lateral side 117. In some embodiments, tongue 127 can substantially fill throat opening 129.

Tongue 127 can be attached to forefoot region 111 using any suitable device or method. For example, as shown in FIG. 17, tongue 127 can be attached to forefoot region 111 via stitching 133 to define a seam 135. More specifically, stitching 133 can extend through the thickness of both forefoot region 111 and tongue 127 for attachment. However, it will be appreciated that tongue 127 could be attached via adhesives, fasteners, or other attachment devices.

In the embodiments of FIG. 17, knitted component 101 of tongue 127 can include a plurality of wave features 192, which can be similar to the wave features 12 described above in relation to FIGS. 1-7. In some embodiments, wave features 192 can oriented such that wave features 192 extend longitudinally between midfoot region 112 and forefoot region 111. Also, ridge structures of wave features 192 can project away from void 122 while channel structures can be recessed inward toward void 122.

In some embodiments, footwear 100 can additionally include a securement device 130. Securement device 130 can be used by the wearer to adjust the dimensions of the footwear 100. For example, securement device 130 can be used by the wearer to selectively vary the girth, or width of footwear 100. Securement device 130 can be of any suitable type, such as a shoelace, a strap, a buckle, or any other device. In the embodiment of FIG. 17, for example, securement device 130 can include a shoelace that is secured to both lateral side 115 and medial side 117. By tensioning securement device 130, lateral side 115 and medial side 117 can be pulled toward each other to tighten footwear 100 onto the wearer's foot. As such, footwear 100 can be tightly secured to the wearer's foot. By reducing tension in securement device 130, footwear 100 can be loosened, and footwear 100 can be easier to put on or remove from the wearer's foot.

Figure 18:
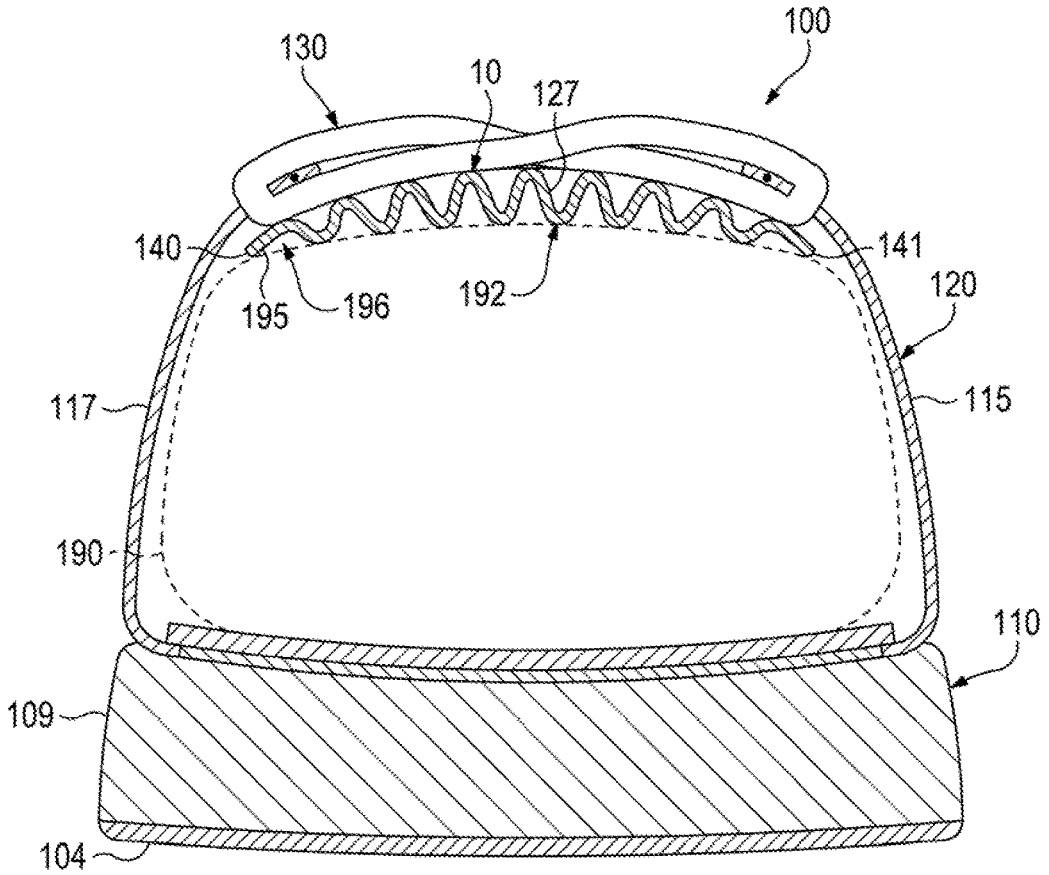
FIG. 18 is a cross section of the article of footwear taken along the line 18-18 of FIG. 17.

As shown in FIG. 18, tongue 127 can be disposed generally between securement device 130 and the wearer's foot 190, which is shown with broken lines. In some embodiments, securement device 130 and/or other portions of upper 120 can compress one or more wave features 192 in tongue 127 against the wearer's foot 190. For example, as shown in FIG. 18, wave features 192 at edge 140 can deform due to compressive loads applied by securement device 130 and medial side 117. Likewise, wave features 192 at edge 141 can deform due to compressive loads applied by securement device 130 and lateral side 115. As discussed above, this deformation can cushion the foot 190 and/or distribute these compressive loads across the foot 190 for greater comfort.

Moreover, it is noted that in the embodiment of FIG. 18, wave features 192 at end 140 and at end 141 are ridge structures 195. These ridge structures 195 can be similar to the ridge structures 30 discussed above in relation to FIGS. 1-7. Ridge structures 195 can define an opening 196 that faces the foot 190. Accordingly, when ridge structures 195 deform, opening 196 can grow larger to better conform end 141 to the curvature of foot 190. Thus, tongue 127 can further increase comfort for the wearer.

Figure 19:
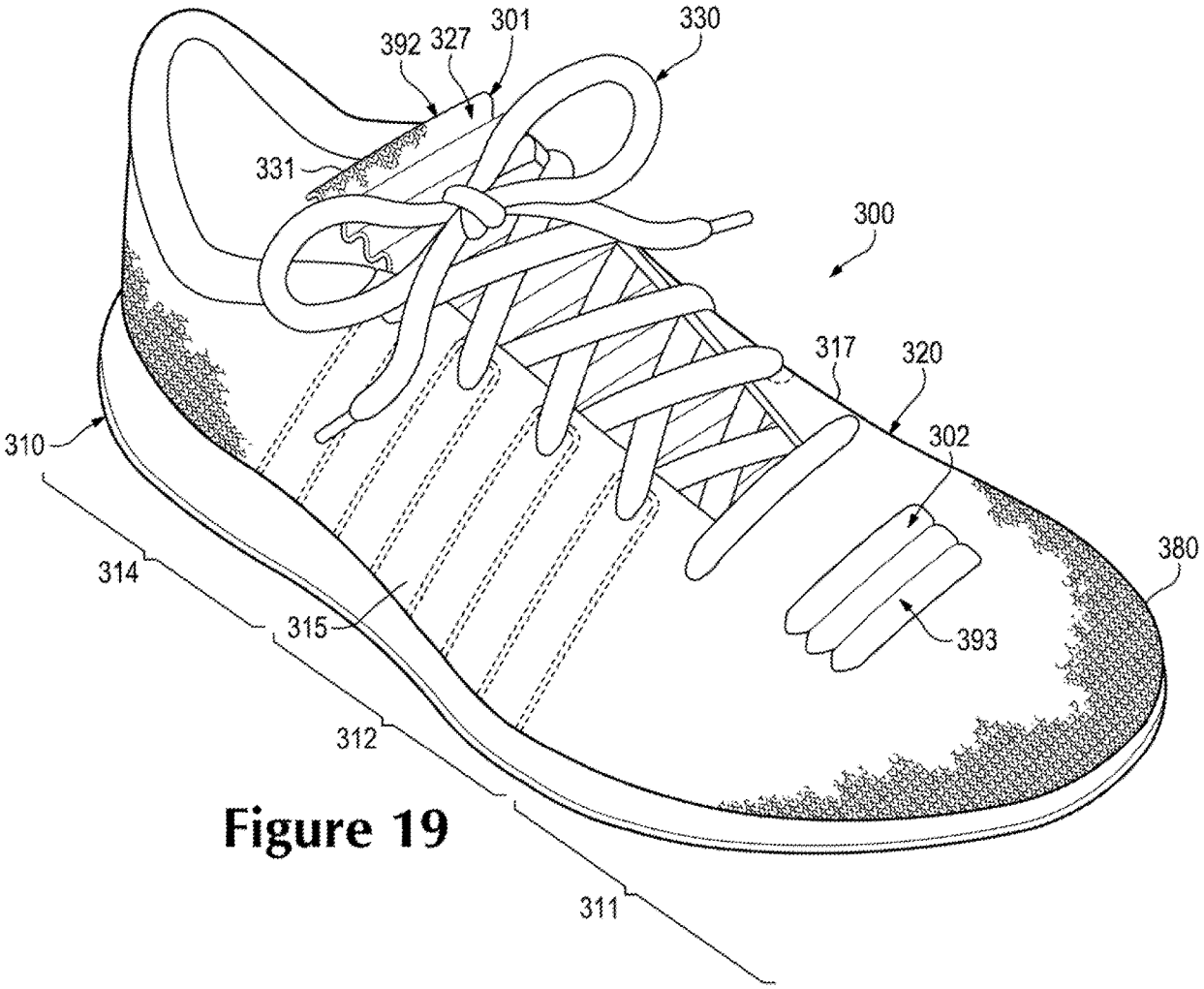
FIG. 19 is a perspective view of an article of footwear that includes a knitted component according to additional embodiments of the present disclosure.

Referring now to FIG. 19, an article of footwear 300 is illustrated according to additional embodiments. Article of footwear 300 can include one or more similar features to article of footwear 100 discussed above in relation to FIGS. 17 and 18. Thus, footwear 300 can include a forefoot region 311, a midfoot region 312, and heel region 314. Footwear 300 can also include a lateral side 315 and a medial side 317. Moreover, footwear 300 can include a sole structure 310 and an upper 320. Also, footwear 300 can include a securement device 330, such as a shoelace.

Footwear 300 can also include a tongue 327 with a plurality of wave features 392 similar to the embodiments discussed above. However, wave features 392 can be oriented differently from the embodiments of FIGS. 17 and 18. For example, wave features 392 can extend longitudinally between lateral side 315 and medial side 317. Accordingly, tongue 327 can be stretched and increased in length in a direction away from forefoot region 311 to ensure that tongue 327 covers over the wearer's foot. It will be appreciated also that wave features 392 can deform under compression to provide cushioning as discussed above with respect to FIGS. 7 and 18.

Also, tongue 327 can be integrally connected to adjacent areas of upper 320. For example, upper 320 can include a knitted component 380 formed of unitary knit construction. Knitted component 380 can define medial side 317, lateral side 315, and/or forefoot region 311, and knitted component 380 can also define tongue 327 in some embodiments. Stated differently, tongue 327 can be formed of unitary knit construction with adjacent portions of knitted component 380 of upper 320. For example, as shown in the embodiment of FIG. 19, tongue 327 can be formed of unitary knit construction with forefoot region 311 of knitted component 380 of upper 320.

Figure 20:
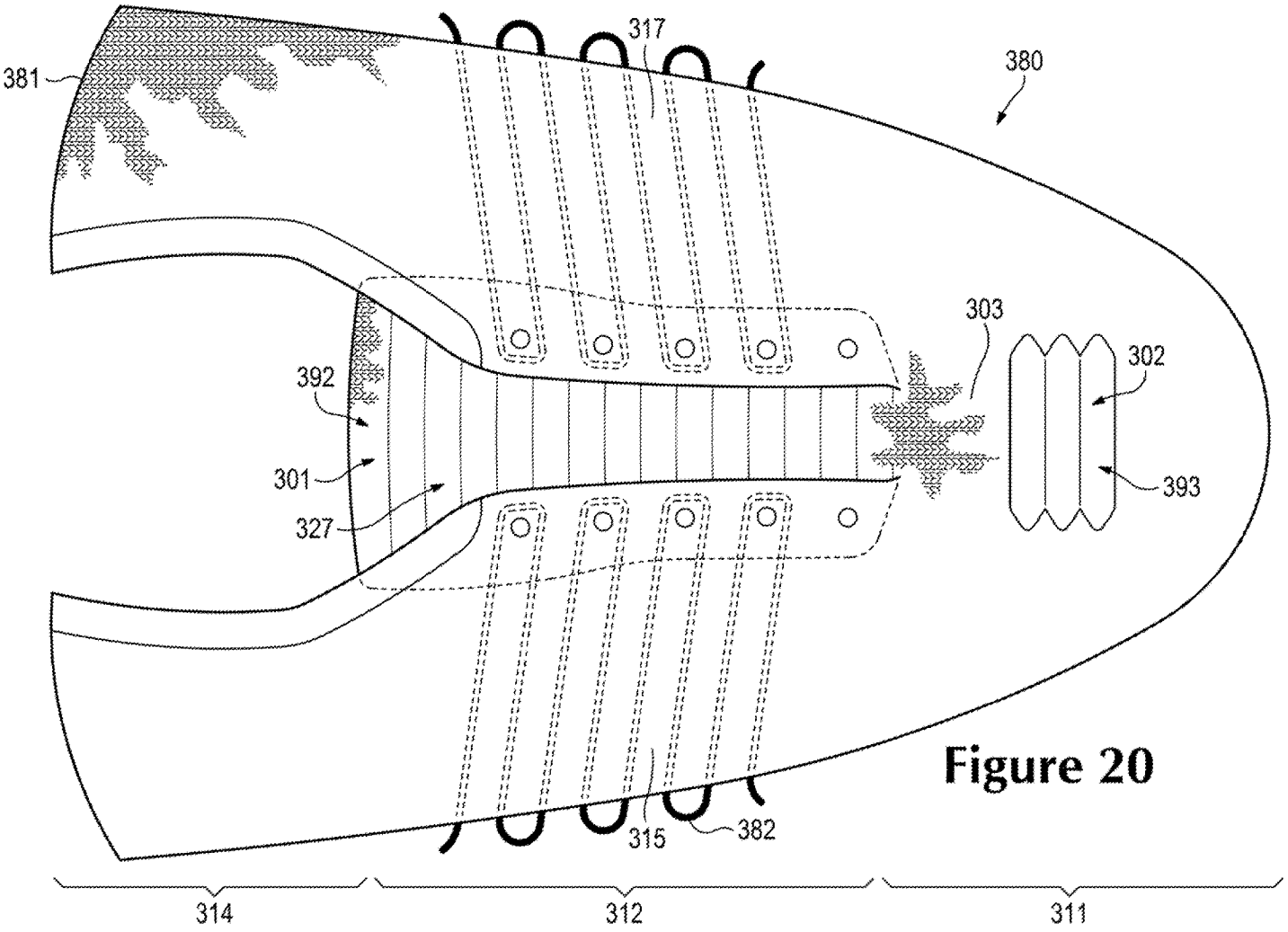
FIG. 20 is a plan view of an upper of the article of footwear of FIG. 19.

An exemplary embodiment of knitted component 380 is shown in plan view in FIG. 20. Examples of various configurations of knitted component 380 and methods for forming knitted component 380 with unitary knit construction are disclosed in U.S. Pat. No. 8,448,474 to Tatler et al., the disclosure of which is incorporated by reference in its entirety.

As shown in FIG. 20, knitted component 380 can include a knit element 381. Knit element 381 can define a majority of knitted component 380 in some embodiments. Knitted component 380 can also include one or more tensile strands 382. Tensile strands 382 as well as the method of manufacturing a knitted component incorporating a tensile strand and knit structures, for use in the embodiments described herein is disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, the disclosure of each being incorporated by reference in its entirety.

As mentioned above, knitted component 380 can at least partially define tongue 327, including wave features 392 on tongue 327. Thus, tongue 327 can be referred to as a first wavy portion 301 of knitted component 380. As shown in FIGS. 19 and 20, knitted component 380 can additionally include a second wavy portion 302. Second wavy portion 302 can include a plurality of wave features 393, which can include features to the wave features discussed in detail above.

Second wavy portion 302 can be spaced apart from first wavy portion 301 of tongue 327 in some embodiments. For example, a comparatively flat portion 303 can be defined between first wavy portion 301 and second wavy portion 302.

Second wavy portion 302 can be disposed in any suitable location on knitted component 380. For example, in some embodiments, second wavy portion 302 can be included in forefoot region 311 of knitted component 380.

Wave features 393 can also have any suitable orientation on knitted component 380. For example, wave features 393 extend longitudinally between lateral side 315 and medial side 317.

Accordingly, wave features 393 can stretch to conform to the wearer's foot, such as the toes of the foot. Also, wave features 393 can stretch to allow the wearer's foot to move within upper 320. Moreover, in some embodiments, the wave features 393 can deform upon impact, for example, with a soccer ball, a hackey-sack, or other object. This can reduce impact energy and allow the wearer to better control the impacting object.

Referring now to FIG. 21, additional embodiments of the present disclosure are disclosed. As shown, one or more knitted components of the type discussed above can be incorporated into an article of apparel 400.

It will be appreciated that article of apparel 400 can be of any suitable type. For example, as shown in FIG. 21, article of apparel 400 is a sports bra. Apparel 400 can include at least one strap 401. Strap 401 can be used to support and secure cups 421 on the wearer's body.

Moreover, strap 401 can include a knitted component 402 having a plurality of wave features 403 of the type discussed above. Accordingly, wave features 403 can deform resiliently and provide added comfort without compromising support. For example, wave features 403 can deform to allow strap 401 to stretch and elongate due to weight loads from cups 421. Also, the resilience of wave features 403 can allow strap 401 to recover to its unloaded length. Accordingly, the stretching and recovery of straps 401 can attenuate cyclical loading in some embodiments. Additionally, wave features 403 can deform under compression to conform to the wearer's body and/or to provide cushioning.

Still further, FIG. 22 illustrates additional embodiments of the present disclosure. For example, a container article 500 is illustrated. In some embodiments, container article 500 can include one or more features that are similar to a duffel bag. In other embodiments, container article 500 can include features similar to a backpack or other container.

Container article 500 can include a container body 501 and a strap 502. Strap 502 can include a plurality of wave features 503 similar to the wave features discussed above. Strap 502 can support container body 501 and can extend over the user's shoulder in some embodiments. Thus, wave features 503 can resiliently deform to allow strap 502 to lengthen under a load from container body 501. Wave features 503 can attenuate cyclical loading in some embodiments. Also, wave features 503 can deform under compression, for example, to allow strap 503 to conform to the user's body and/or to provide cushioning.

It will further be appreciated that knitted components of the types discussed herein can be incorporated into other articles as well. For example, these knitted components can be included in a hat or helmet in some embodiments. In some embodiments, the knitted component can be a liner for the hat or helmet. Thus, the resiliency of the knitted component can allow the hat/helmet to conform to the wearer's head. The knitted component can also provide cushioning for the wearer's head.

In additional embodiments, the knitted component can be included in an article of footwear and can be configured to be disposed underneath the wearer's foot. For example, the knitted component can be an insole for an article of footwear. In some embodiments, the insole can be a removable insert that can be disposed within the footwear, underneath the wearer's foot. Also, in some embodiments, the knitted component can define a strobel member for the upper of an article of footwear. Thus, knitted component can extend between and can connect to the medial and lateral side of the upper, and the knitted component can provide cushioning for sole of the wearer's foot.

In summary, the knitted component of the present disclosure can be resilient and can deform under various types of loads. This resilience can provide cushioning, for example, to make the article more comfortable to wear. This resilience can also allow the article to stretch and recover back to an original length. Accordingly, in some embodiments, knitted component can allow the article to conform to the wearer's body and/or to attenuate loads. Furthermore, the knitted component can be efficiently manufactured.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

What is claimed is:

1. A knitted component that provides resiliency to an object, the knitted component comprising:

a ridge structure that includes a plurality of ridge courses, the ridge courses being inherently biased to curl about a first axis in a first direction toward a compacted position of the ridge structure, the first axis being parallel to a longitudinal direction of the ridge courses, and at least one ridge course of the plurality of ridge courses having loops that are intermeshed with an adjacent ridge course;

a channel structure that is adjacent the ridge structure, the channel structure including a plurality of channel courses, the channel courses being inherently biased to curl about a second axis in a second direction toward a compacted position of the channel structure, the second axis being parallel to a longitudinal direction of the channel courses, the first direction being opposite the second direction, and at least one channel course of the plurality of channel courses having loops that are intermeshed with an adjacent channel course; and a first bridge portion, the first bridge portion including a yarn segment that extends across the channel structure to limit an extended position of the channel structure, wherein the yarn segment is excluded from all knitted loops of the knitted component, the ridge structure configured to move between the compacted position and an extended position, the channel structure configured to move between the compacted position and the extended position, the plurality of ridge courses extending in the same direction as the first axis, the plurality of channel courses extending in the same direction as the second axis, and the ridge structure configured to uncurl toward the extended position of the ridge structure in response to a force applied to the ridge structure, and the channel structure being configured to uncurl toward the extended position of the channel structure in response to a force applied to the channel structure.

2. The knitted component of claim 1, wherein the ridge structure includes an apex, a first side wall, and a second side wall, wherein the first side wall and the second side wall of the ridge structure extend away from each other from the apex, wherein the channel structure includes a nadir, a first side wall, and a second side wall, wherein the first side wall and the second side wall of the channel structure extend away from each other from the nadir, wherein the first side wall of the ridge structure is attached to the second side wall of the channel structure, wherein the first side wall and the second side wall of the ridge structure curl in the first direction when moving away from the extended position toward the compacted position, and wherein the first side wall and the second side wall of the channel structure curl in the second direction when moving away from the extended position toward the compacted position.

3. The knitted component of claim 1, wherein the knitted component defines a longitudinal direction and a lateral direction, wherein the knitted component further comprises an adjacent ridge structure, the adjacent ridge structure configured to move between a compacted position and an extended position, the adjacent ridge structure being biased to curl in the first direction toward the compacted position of the adjacent ridge structure, wherein the ridge structure, the channel structure, and the adjacent ridge structure extend in the longitudinal direction, wherein the ridge structure, the channel structure, and the adjacent ridge structure are spaced apart in the lateral direction, wherein the channel structure is disposed between the ridge structure and the adjacent ridge structure, wherein the ridge structure is connected to the channel structure to define a first transition between the ridge structure and the channel structure, wherein the channel structure is connected to the adjacent ridge structure to define a second transition between the channel structure and the adjacent ridge structure, and wherein the knitted component is configured to stretch in the lateral direction between a neutral position and a stretched position, the knitted component biased toward the neutral position, the first transition being closer to the second transition in the neutral position than in the stretched position.

4. The knitted component of claim 3, wherein the ridge structure and the adjacent ridge structure abut when the knitted component is in the neutral position.

5. The knitted component of claim 1, wherein the ridge structure includes a first yarn and the channel structure includes a second yarn.

6. The knitted component of claim 5, wherein the first yarn and the second yarn differ in appearance.

7. The knitted component of claim 1, further comprising: a second bridge portion being different than the channel structure and the ridge structure, wherein the second bridge portion extends across the ridge structure, and wherein the second bridge portion includes a second yarn segment that limits the extended position of the ridge structure, the second yarn segment being excluded from all knitted loops of the knitted component.

8. The knitted component of claim 1, wherein the ridge structure has one of a front jersey knit structure and a reverse jersey knit structure, and wherein the channel structure has the other of the front jersey knit structure and the reverse jersey knit structure.

9. The knitted component of claim 1, wherein the ridge structure includes at least four ridge courses, and wherein the channel structure includes at least four channel courses.

10. The knitted component of claim 1, wherein the object is an upper of an article of footwear, and wherein at least one of the ridge structure and the channel structure is attached to an adjacent portion of the upper.

11. An article of footwear comprising:

a sole structure; and an upper that is attached to the sole structure, the upper including a knitted component, the knitted component comprising:

a ridge structure that includes a plurality of ridge courses, the ridge courses being inherently biased to curl about a first axis in a first direction toward a compacted position of the ridge structure, the first axis being parallel to a longitudinal direction of the ridge courses;

a channel structure that is adjacent the ridge structure, the channel structure including a plurality of channel courses, at least one of the channel courses including a plurality of adjacent loops within the channel structure, where each loop of the plurality of adjacent loops is intermeshed with a loop of an adjacent channel course, the channel courses being inherently biased to curl about a second axis in a second direction toward a compacted position of the channel structure, the first direction being opposite the second direction, and the second axis being parallel to a longitudinal direction of the channel courses; and a first bridge portion, the first bridge portion including a yarn segment that extends across the channel structure to limit an extended position of the channel structure, wherein the yarn segment is excluded from all knitted loops of the knitted component, the ridge structure configured to move between the compacted position and an extended position, the channel structure configured to move between the compacted position and the extended position, the plurality of ridge courses extending in the same direction as the first axis, the plurality of channel courses extending in the same direction as the second axis, wherein at least one ridge course includes a plurality of loops, the ridge structure configured to uncurl toward the extended position of the ridge structure in response to a force applied to the ridge structure, and the channel structure being configured to uncurl toward the extended position of the channel structure in response to a force applied to the channel structure.

12. The article of footwear of claim 11, wherein the ridge structure includes an apex, a first side wall, and a second side wall, wherein the first side wall and the second side wall of the ridge structure extend away from each other from the apex, wherein the channel structure includes a nadir, a first side wall, and a second side wall, wherein the first side wall and the second side wall of the channel structure extend away from each other from the nadir, wherein the first side wall of the ridge structure is attached to the second side wall of the channel structure, wherein the first side wall and the second side wall of the ridge structure curl in the first direction when moving away from the extended position toward the compacted position, and wherein the first side wall and the second side wall of the channel structure curl in the second direction when moving away from the extended position toward the compacted position.

13. The article of footwear of claim 11, wherein the upper defines a void that is configured to receive a foot, wherein the upper defines a medial side, a lateral side, and a throat opening defined between the medial side and the lateral side, further comprising a securement member that is attached to the medial side and the lateral side, wherein the securement member is configured to move the medial side relative to the lateral side to change a size of the void, and wherein the knitted component defines a tongue that is disposed within the throat opening with the channel structure extending toward the void and the ridge structure projecting away from the void.

14. The article of footwear of claim 13, wherein the throat opening is defined by a throat edge, and wherein the knitted component includes a terminal edge that is removably attached to the throat edge at a seam.

15. The article of footwear of claim 13, wherein the knitted component also defines at least one of the medial side, the lateral side, and a forefoot region of the upper, and wherein the tongue is formed of unitary knit construction with the at least one of the medial side, the lateral side, and the forefoot region of the upper.

16. A knitted component comprising:

a first ridge structure that includes a plurality of ridge courses, wherein the first ridge structure is inherently biased to curl about a first axis in a first direction, and wherein the plurality of ridge courses extend in the same direction as the first axis, the first axis being parallel to a longitudinal direction of the ridge courses;

a second ridge structure that includes a plurality of ridge courses, wherein the second ridge structure is inherently biased to curl about a third axis in the first direction, the third axis extending parallel to the first axis;

a first channel structure located between the first ridge structure and the second ridge structure, wherein the first channel structure includes a plurality of channel courses, wherein the first channel structure is inherently biased to curl about a second axis in a second direction, wherein the first direction is opposite of the second direction, and wherein the plurality of channel courses extends in the same direction as the second axis, the second axis being parallel to a longitudinal direction of the channel courses; and a first bridge portion, the first bridge portion including a first yarn segment that extends across the first channel structure to limit an extended position of the first channel structure, and wherein the first yarn segment is excluded from all knitted loops of the knitted component.

17. The knitted component of claim 16, further comprising: a second channel structure, wherein the second ridge structure is located between the first channel structure and the second channel structure; and a second bridge portion, the second bridge portion including a second yarn segment that extends across the second ridge structure to limit an extended position of the second ridge structure, wherein the second yarn segment is excluded from all knitted loops of the knitted component.

* * * * *